US007307601B2

(12) United States Patent
Lee et al.

(10) Patent No.: US 7,307,601 B2
(45) Date of Patent: Dec. 11, 2007

(54) DRIVING METHOD AND DEVICE OF PLASMA DISPLAY PANEL AND PLASMA DISPLAY DEVICE

(75) Inventors: Jun-Young Lee, Suwon-si (KR); Jin-Sung Kim, Suwon-si (KR); Nam-Sung Jung, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 556 days.

(21) Appl. No.: 10/992,778

(22) Filed: Nov. 22, 2004

(65) Prior Publication Data

US 2005/0116894 A1 Jun. 2, 2005

(30) Foreign Application Priority Data

Nov. 27, 2003 (KR) ..... 10-2003-0085122

(51) Int. Cl.
*G09G 3/28* (2006.01)

(52) U.S. Cl. ..... 345/60; 345/63; 345/69

(58) Field of Classification Search ..... 345/60–70
See application file for complete search history.

(56) References Cited

U.S. PATENT DOCUMENTS 4,866,349 A 9/1989 Weber et al.
5,081,400 A 1/1992 Weber et al.
5,717,437 A 2/1998 Sano et al.
5,943,030 A 8/1999 Minamibayashi ..... 345/60
6,011,355 A 1/2000 Nagai ..... 315/169.3
6,028,573 A 2/2000 Orita et al. ..... 345/66

FOREIGN PATENT DOCUMENTS

KR 1020010103509 11/2001

*Primary Examiner*—Duc Q Dinh
(74) *Attorney, Agent, or Firm*—H.C. Park & Associates, PLC

(57) ABSTRACT

In an address driving circuit including a power recovery circuit, the voltage of the address electrode is reduced through a transistor, and the voltage of the address electrode increases through the current formed by the body diode of the transistor. In addition, the ground voltage is not applied to the address electrode in the power recovery circuit after the voltage of the address electrode is reduced. As a result, the resonance for raising the voltage of the address electrode and the resonance for reducing the voltage of the address electrode can be performed through the same transistor, and the transistor for applying the ground voltage to the address electrode can be eliminated.

42 Claims, 22 Drawing Sheets

DRIVING METHOD AND DEVICE OF PLASMA DISPLAY PANEL AND PLASMA DISPLAY DEVICE

CROSS REFERENCE TO RELATED APPLICATION

This application claims priority to and the benefit of Korea-Patent Application No. 10-2003-0085122 filed on Nov. 27, 2003 in the Korean Intellectual Property Office, the contents of which is incorporated herein by reference.

BACKGROUND OF THE INVENTION

1. Field of the Invention

The present invention relates to a driving method and a driving device of a plasma display panel (PDP) and a plasma display device. More specifically, the present invention relates to an address driving circuit for applying address voltages.

2. Background Description

A PDP is a flat display that uses plasma generated via a gas discharge process to display characters or images. Tens to millions of pixels may be provided thereon in a matrix format, depending on its size. PDPs are categorized into DC PDPs and AC PDPs, according to supplied driving voltage waveforms and discharge cell structures.

Since the DC PDPs have electrodes exposed in the discharge space, they allow a current to flow in the discharge space while the voltage is supplied. Therefore, resistors are required for current restriction. Since the AC PDPs have electrodes covered by a dielectric layer, capacitances are naturally formed to restrict the current, and the electrodes are protected from ion shocks in the case of discharging. Accordingly, they have a longer lifespan than the DC PDPs.

FIG. 1 shows a perspective view of an AC PDP. As shown, a scan electrode 4 and a sustain electrode 5, disposed over a dielectric layer 2 and a protection film 3, are provided in parallel and form a pair with each other under a first glass substrate 1. A plurality of address electrodes 8 covered with an insulation layer 7 are installed on a second glass substrate 6. Barrier ribs 9 are formed in parallel with the address electrodes 8, on the insulation layer 7 between the address electrodes 8. Phosphor 10 is formed on the surface of the insulation layer 7 between the barrier ribs 9. The first and second glass substrates 1 and 6 have a discharge space 11 between them and are provided facing each other so that the scan electrode 4 and the sustain electrode 5 may cross the address electrodes 8. The address electrode 8 and a discharge space 11 formed at a crossing part of the scan electrode 4 and the sustain electrode 5 form a discharge cell 12.

FIG. 2 shows a PDP electrode arrangement diagram. The PDP electrode has an m×n matrix configuration. In detail, it has address electrodes $A_1$ to $A_m$ in the column direction, and scan electrodes $Y_1$ to $Y_n$ and sustain electrodes $X_1$ to $X_n$ in the row direction, alternately. The discharge cell 12 shown in FIG. 2 corresponds to the discharge cell 12 shown in FIG. 1.

In general, a method for driving the AC PDP includes a reset period, an address period, and a sustain period.

In the reset period, the states of the respective cells are reset in order to smoothly address the cells. In the addressing period, the cells that are turned on and the cells that are not turned on in a panel are selected. Wall charges accumulate in the cells that are turned on (i.e., the addressed cells). In the sustain period, discharge is performed in order to actually display pictures on the addressed cells.

Since a discharge space between a scan electrode and a sustain electrode and a discharge space between a surface on which an address electrode is formed and a surface on which scan and sustain electrodes are formed operate as capacitive loads (referred to hereinafter as panel capacitors), capacitance exists on the panel. Hence, reactive power for injecting charges to the capacitance is needed in addition to power for addressing in order to apply waveforms for addressing. An address driving circuit of the PDP includes a power recovery circuit for recovering the reactive power and re-using the same, such as that disclosed in the power recovery circuit by L. F. Weber in U.S. Pat. Nos. 4,866,349 and 5,081,400.

A conventional power recovery circuit can restrict the power consumption within a predetermined level when the images which need the high power consumption are displayed. However, the conventional power recovery circuit is operated even though the images which need the low power consumption are displayed. As a result, when the images which need the low power consumption are displayed, the power consumption of the conventional power recovery circuit is higher than the circuit not having a power recovery function. For example, in the display pattern in which all discharge cells are on, the addressing voltage is continuously applied to the address electrodes. Therefore, there is no need for the power recovery operation to be performed in this display pattern. However, the power consumption increases since the conventional power recovery circuit performs the power recovery operation in this display pattern.

In addition, conventional power recovery circuits may fail to change the voltage of the panel capacitor to the desired voltage because of a switching loss of transistors or parasitic components of the circuit. The switch performs hard switching, and hence the power consumption increases.

Furthermore, the manufacturing cost of the conventional power recovery circuit is higher, since it needs four switches and two diodes. That is, the conventional power recovery circuit needs a first switch for generating the resonance current for increasing the voltage of the panel capacitor, a second switch for generating the resonance current for reducing the voltage of the panel capacitor, a third switch for supplying the addressing voltage to the panel capacitor, a fourth switch for supplying the grounding voltage to the panel capacitor, a first diode for forming the resonance path with the first switch, and a second diode for forming the resonance path with the second switch.

SUMMARY OF THE INVENTION

An embodiment of the present invention provides an address driving circuit for reducing the power consumption.

An embodiment of the present invention provides an address driving circuit for reducing the manufacturing cost.

In one aspect of the present invention, a plasma display device includes a panel including a plurality of first electrodes extending in a first direction and a plurality of second electrodes extending in a second direction intersecting the first electrodes, a first driving circuit sequentially applying a first voltage to the first electrodes, a plurality of selecting circuits respectively coupled to the second electrodes, for selecting second electrodes to which a second voltage will be applied from among the second electrodes, and a second driving circuit coupled to first ends of the selecting circuits, for applying the second voltage to the second electrodes selected by the selecting circuits. The second driving circuit includes a capacitor, a first transistor having a first end coupled to the first end of the selecting circuit and a second end coupled to a first end of the capacitor, an inductor coupled between the first ends of the selecting circuits and the first end of the first transistor or between the second end of the first transistor and the first end of the capacitor, and a second transistor coupled between the first ends of the selecting circuits and a voltage source supplying the second voltage.

In another aspect of the present invention, a plasma display device includes a panel including a plurality of first electrodes extending in a first direction and a plurality of second electrodes extending in a second direction intersecting the first electrodes, a first driving circuit sequentially applying a first voltage to the first electrodes, a plurality of selecting circuits respectively coupled to the second electrodes, for selecting second electrodes to which data will be applied from among the second electrodes, and a second driving circuit including a first transistor having a body diode, an inductor, and a capacitor, for applying the second voltage to the second electrodes selected by the selecting circuits. The second driving circuit applies the second voltage to the selected electrode after charging a capacitive load formed by the selected second electrode and the first electrode by discharging the capacitor through the inductor, and charges the capacitor by discharging the capacitive load through the inductor. A current charging the capacitive load includes a current flowing through the first transistor, and a current discharging the capacitive load includes a current flowing through the body diode of the first transistor.

In still another aspect of the present invention, a plasma display device includes a panel including a plurality of first electrodes extending in a first direction and a plurality of second electrodes extending in a second direction intersecting the first electrodes, a first driving circuit sequentially applying a first voltage to the first electrodes, a plurality of selecting circuits respectively coupled to the second electrodes, for selecting second electrodes to which data will be applied from among the second electrodes, and a second driving circuit including a first transistor, a first diode coupled in parallel to the first transistor, an inductor, and a capacitor, for applying the second voltage to the second electrodes selected by the selecting circuits. The second driving circuit applies the second voltage to the selected electrode after charging a capacitive load formed by the selected second electrode and the first electrode by discharging the capacitor through the inductor, and charges the capacitor by discharging the capacitive load through the inductor. A current charging the capacitive load includes a current flowing through the first transistor, and a current discharging the capacitive load includes a current flowing through the body diode of the first transistor.

In a further aspect of the present invention, a driving device of a plasma display panel on which a plurality of address electrodes and scan electrodes are formed, a capacitive load being formed by the address electrode and the scan electrode, includes an inductor having a first end coupled to the address electrode,; a capacitor having a first end coupled to a second end of the inductor and a second end coupled to a first voltage source supplying a first voltage, a first transistor coupled between the second end of the inductor and the first end of the capacitor or between the address electrodes and the first end of the inductor, the first transistor forming a current path of a first direction when being turned on, a first diode coupled in parallel to the transistor, forming a current path of a second direction, and a second transistor coupled between the address electrodes and a second voltage source supplying a second voltage. The voltage of the address electrode is reduced by a first current of the first direction formed by turn-on of the first transistor, and the voltage of the address electrode increases by a second current of the second direction formed by the first diode after the current of the first direction is reduced.

In a yet further aspect of the present invention, a driving method of a plasma display panel on which a plurality of first electrodes and second electrodes are formed, and which includes an inductor coupled to first ends of selecting circuits having output ends coupled to the first electrodes, a capacitive load being formed by the first electrode and the second electrode, the driving method includes reducing the voltages of the first electrodes selected by the selecting circuits among the first electrodes by discharging a current in a first direction from the selected first electrodes through the inductor, selecting the first electrodes to which a first voltage will be applied, among the first electrodes selected by the selecting circuits, raising the voltages of the selected first electrodes by using a current of a second direction which is formed through the inductor after the current of the first direction is about 0 amperes and is opposite to the first direction; and applying the first voltage to the selected first electrodes. The current path of the first direction is formed through a transistor coupled to the inductor, and the current path of the second direction is formed through a diode coupled in parallel to the transistor. By way of an additional exemplary embodiment of the invention, a plasma display device includes a panel including a plurality of first electrodes extending in a first direction and a plurality of second electrodes extending in a second direction intersecting the first electrodes, a mechanism that acts to sequential apply a first voltage to the first electrodes. The device further includes a plurality of mechanisms that act to select, respectively coupled to the second electrodes, and for selecting second electrodes to which data will be applied from among the second electrodes, and a mechanism that acts to apply the second voltage to the second electrodes selected by the selecting circuits. The mechanism that acts to apply the second voltage applies the second voltage to the selected electrode after charging a capacitive load formed by the selected second electrode and the first electrode by discharging a capacitor through an inductor, and charges the capacitor by discharging the capacitive load through the inductor. A current charging the capacitive load includes a current flowing in a first direction through the mechanism that acts to apply the second voltage, and a current discharging the capacitive load includes a current flowing in a second direction through the mechanism that acts to apply the second voltage.

A further exemplary embodiment of the present invention provides a plasma display device including a panel including a plurality of first electrodes extending in a first direction and a plurality of second electrodes extending in a second direction intersecting the first electrodes and a mechanism that acts to apply a first voltage to the first electrodes. The device further includes a plurality of mechanisms that act to select, respectively coupled to the second electrodes and for selecting second electrodes to which data will be applied from among the second electrodes and a mechanisms that acts to apply the second voltage to the second electrodes selected by the mechanisms that act to select. The mechanism that acts to apply the second voltage applies the second voltage to the selected electrode after charging a capacitive load formed by the selected second electrode and the first electrode by discharging a capacitor through an inductor, and charges the capacitor by discharging the capacitive load through the inductor. A current charging the capacitive load includes a current flowing in a first direction through the mechanism that acts to apply the second voltage, and a current discharging the capacitive load includes a current flowing in a second direction through the mechanism that acts apply the second voltage.

DETAILED DESCRIPTION

In the following detailed description, only the exemplary embodiment of the invention has been shown and described, simply by way of illustration of the best mode contemplated by the inventor(s) of carrying out the invention. As will be realized, the invention is capable of modification in various obvious respects, all without departing from the scope of the invention. Accordingly, the drawings and description are to be regarded as illustrative in nature, and not restrictive.

A plasma display device and a driving method of a PDP now will be described in detail with reference to drawings.

Figure 1:
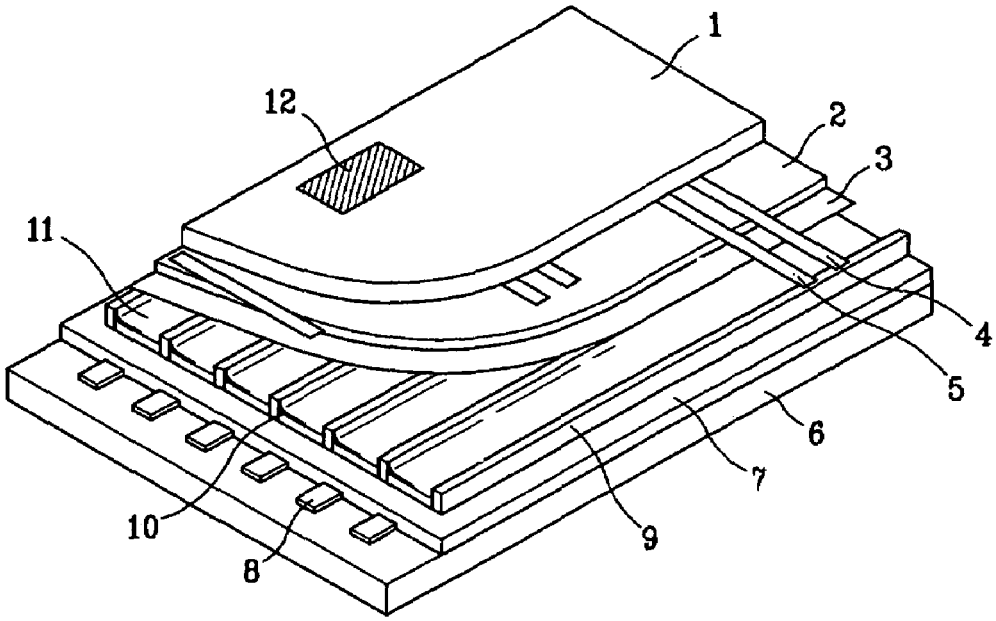
FIG. 1 shows a partial perspective view of an AC PDP.
Figure 2:
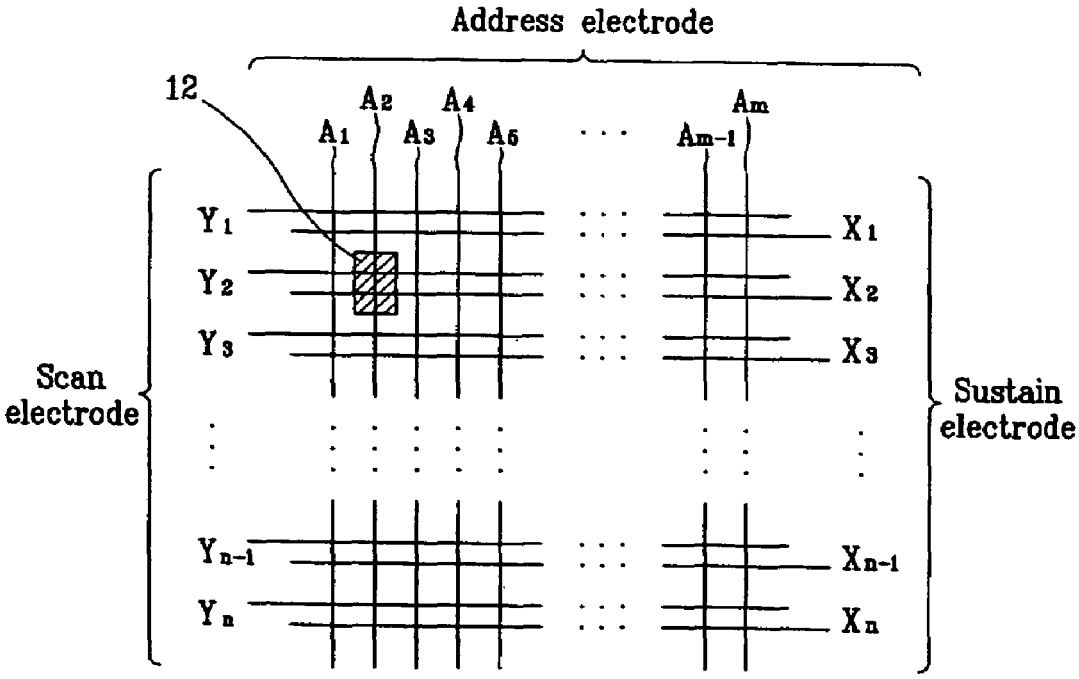
FIG. 2 shows a PDP electrode arrangement diagram.
Figure 3:
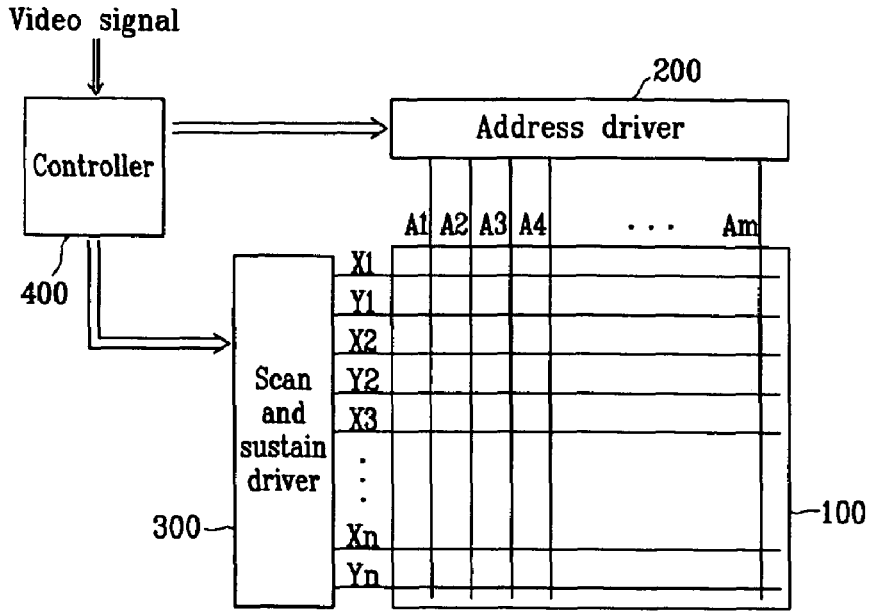
FIG. 3 shows a brief diagram of a plasma display device according to an exemplary embodiment of the present invention.

FIG. 3 shows a brief diagram of a plasma display device according to an exemplary embodiment of the present invention.

The plasma display device includes a PDP 100, an address driver 200, a scan and sustain driver 300, and a controller 400. The scan and sustain driver 300 is illustrated as a single block in FIG. 3, but it also, may be separated into a scan driver and a sustain driver.

The PDP 100 includes a plurality of address electrodes A1 to Am provided in the column direction, and scan electrodes Y1 to Yn and sustain electrodes X1 to Xn provided in pairs in the row direction. The address driver 200 receives an address drive control signal from the controller 400, and applies address signals for selecting discharge cells to be displayed to the respective address electrodes A1 to Am. The scan and sustain driver 300 receives a sustain control signal from the controller 400, and alternately inputs sustain pulses to the scan electrodes Y1 to Yn and sustain electrodes X1 to Xn to sustain the selected discharge cells. The controller 400 receives external video signals, generates an address drive control signal and a sustain control signal, and applies them to the address driver 200 and the scan and sustain driver 300.

In general, a single frame is divided into a plurality of subfields. The subfields are driven in the PDP, and the discharge cells to be discharged are selected. In order to select the discharge cells, a scan voltage is sequentially applied to the scan electrodes, and the scan electrodes to which scan voltage is not applied are biased with a positive voltage in the address period. The voltage for addressing (referred to hereinafter as an address voltage) is applied to the address electrodes that are passed through the discharge cells to be selected from among a plurality of discharge cells formed by the scan electrodes to which the scan voltage is applied. A reference voltage is applied to the address electrodes which are not selected. In general, the address voltage uses a positive voltage and the scan voltage uses a ground voltage or a negative voltage, so that the discharge is generated at the address electrodes to which the address voltage is applied and the scan electrodes to which the scan voltage is applied, and the corresponding discharge cells are selected. The ground voltage is frequently used as the reference voltage.

An address driving circuit in the address driver 200 will be described with reference to FIG. 4 respectively assuming the scan voltage applied to the scan electrodes and the reference voltage applied to the address electrodes as the ground voltage.

Figure 4:
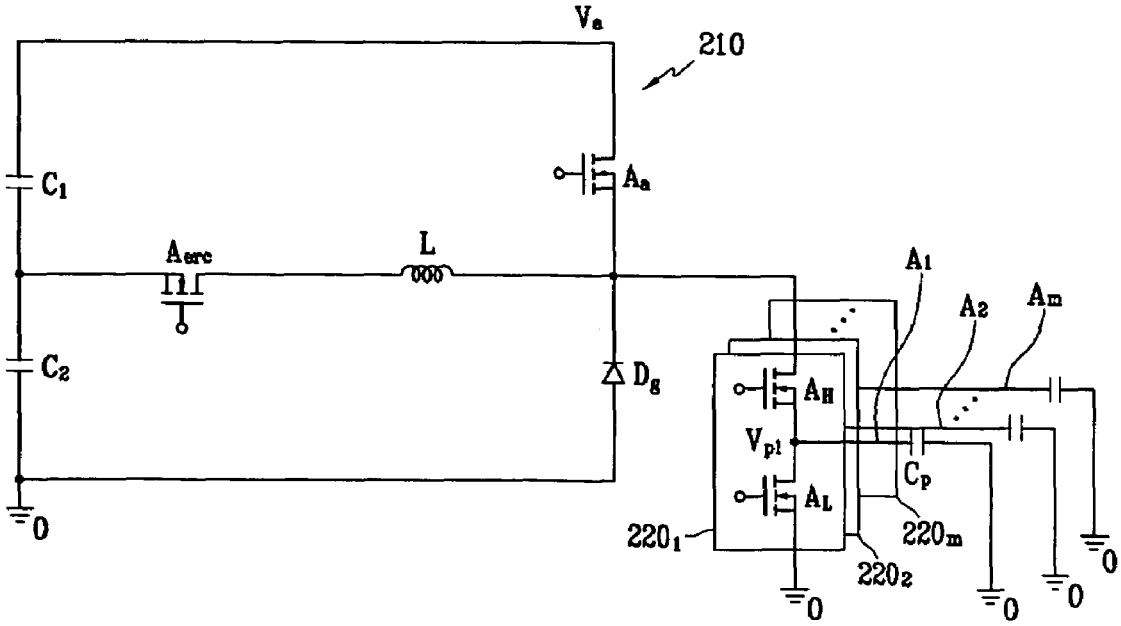
FIG. 4 shows an address driving circuit according to a first exemplary embodiment of the present invention.

FIG. 4 shows an address driving circuit according to a first exemplary embodiment of the present invention. The address driving circuit includes a power recovery circuit 210 and a plurality of address selecting circuits 2201 to 220*m*. The address selecting circuits 2201 to 220*m* are respectively connected to a plurality of address electrodes $A_1$ to $A_m$. Each address selecting circuit has two switches AH and AL as a driving switch and a grounding switch, respectively. The switches AH and AL may be composed of an FET (field-effect transistor) having a body diode or of other types of switches that perform the same or similar functions as the FET. In FIG. 4, each of the switches AH and AL is depicted as an n channel MOSFET. A first end (drain) of the switch AH is connected to the power recovery circuit 210 and a second end (source) of the switch AH is connected to the address electrodes A1 to Am. When the switch AH is turned on, an address voltage Va supplied by the power recovery circuit 210 is transmitted to the address electrodes A1 to Am. The switch AL has a first end (drain) connected to the address electrodes A1 to Am and a second end (source) connected to the reference voltage (ground voltage). When the switch AL is turned on, the ground voltage is transmitted to the address electrodes A1 to Am. Generally, the switches AH and AL are not simultaneously turned on.

The address voltage Va or the ground voltage is applied to the address electrodes A1 to Am when the switches AH and AL of the address selecting circuits 2201 to 220*m*, connected to the address electrodes A1 to Am respectively, are turned on or off by the address drive control signal as described above. That is, the address electrode to which the address voltage Va is applied when the switch AH is turned on is selected, and the address electrode to which the ground voltage is applied when the switch AL is turned on is not selected, in the address period.

The power recovery circuit 210 includes switches Aa and Aerc, an inductor L, a diode Dg, and capacitors C1 and C2. The switches Aa and Aerc may be composed of a FET having a body diode or other types of switches that perform the same or similar functions as the FET. In FIG. 4, each of the switches Aa and Aerc is depicted as an n channel MOSFET. A first end (drain) of the switch Aa is connected to a power supply (or a power line) for supplying the address voltage Va and a second end (source) of the switch Aa is connected to the first end of the switch AH of the address selecting circuits 2201 to 220*m*.

A first end of the inductor L is connected to the first end of the switch AH of the address selecting circuits 2201 to 220*m*, and a first end (drain) of the switch Aerc is connected to a second end of the inductor L. The capacitors C1 and C2 are connected in series between a voltage source for supplying the address voltage Va and the ground voltage, and a second end (source) of the switch Aerc is connected to the common node between the capacitors C1 and C2. The connection sequence of the inductor L and the switch Aerc can be changed. The cathode of the diode Dg is connected to the first end of the switch AH of the address selecting circuits 2201 to 220*m*, and the anode of the diode Dg is connected to the ground voltage, i.e., the negative polarity terminal of the capacitor C2.

A single power recovery circuit 210 is illustrated to be connected to the address selecting circuits 2201 to 220*m* in FIG. 4. In addition, the address selecting circuits 2201 to 220*m* can be divided into a plurality of groups, where a power recovery circuit 210 is connected to each group. The capacitors C1 and C2 are connected in series between the power for supplying the address voltage Va and the ground voltage in FIG. 4, and the capacitor C1 can further be eliminated.

Referring to FIGS. 5 to 12D, an operation of the address driving circuit according to the first exemplary embodiment of the present invention will be described. In FIGS. 5 to 12D, the direction of the current flowing from the first end of the inductor L to the second end of the inductor L is defined as "positive direction," and the direction of the current flowing from the second end of the inductor L to the first end of the inductor L is defined as "negative direction." In addition, a threshold voltage of the semiconductor element (switch or diode) is assumed to be about 0V, since the threshold voltage is lower than a discharging voltage.

Figure 5:
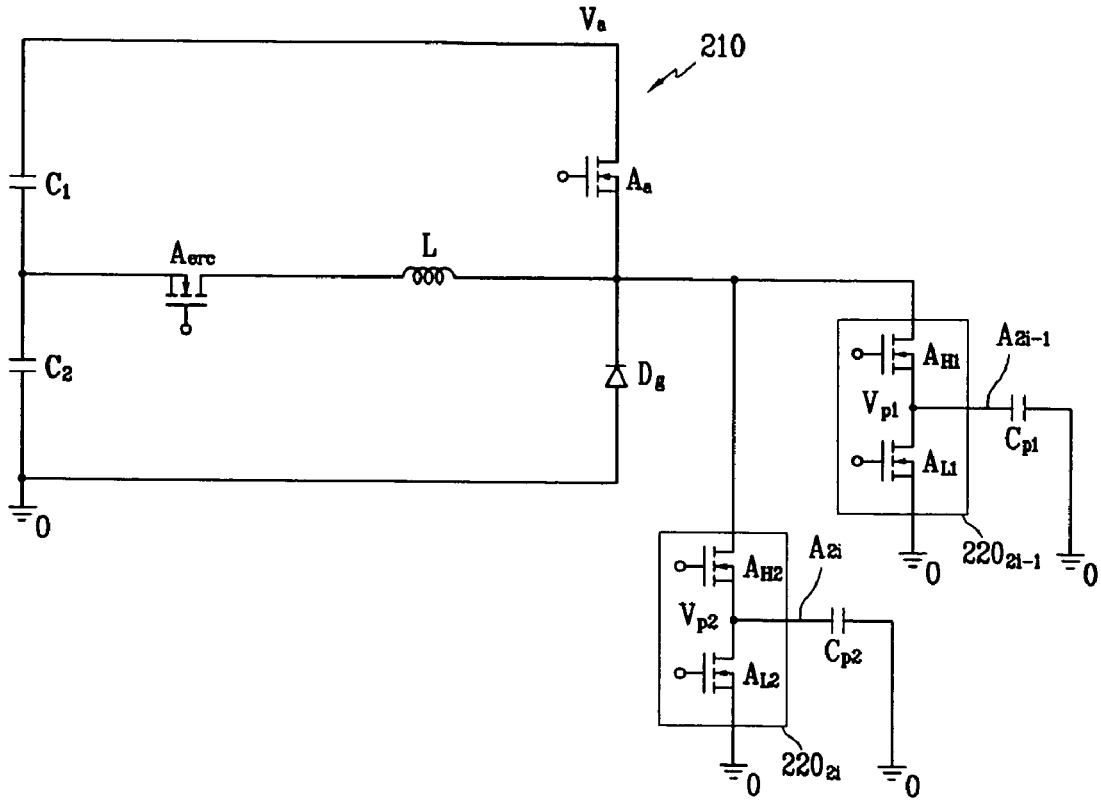
FIG. 5 shows a diagram of the address driving circuit of FIG. 4.

FIG. 5 shows a diagram of the address driving circuit of FIG. 4. For ease of description, only two adjacent address selecting circuits 2202*i* and 2202*i*-1 are illustrated, a capacitive component formed by the address electrode and the scan electrode is illustrated as a panel capacitor, and the ground voltage is applied to the scan electrode part of the panel capacitor.

As shown in FIG. 5, the power recovery circuit 210 is connected to panel capacitors Cp1 and Cp2 through switches AH1 and AH2 of the address selecting circuits 2202*i*-1 and 2202*i*, respectively, and switches AL1 and AL2 of the address selecting circuits 2202*i*-1 and 2202*i* are connected to the ground voltage. The panel capacitor Cp1 is a capacitive component formed by the address electrode A2*i*-1 and the scan electrode, and the panel capacitor Cp2 is a capacitive component formed by the address electrode A2*i* and the scan electrode.

An operation of the address driving circuit will be described by using representative patterns of FIGS. 6 to 8 displayed on a screen in a single subfield. The representative patterns include the dot on/off pattern and the line on/off pattern having many switching variations of the address selecting circuits 2201 to 220*m*, and the full white pattern having less switching variations of the address selecting circuits 2201 to 220*m*.

Figure 6:
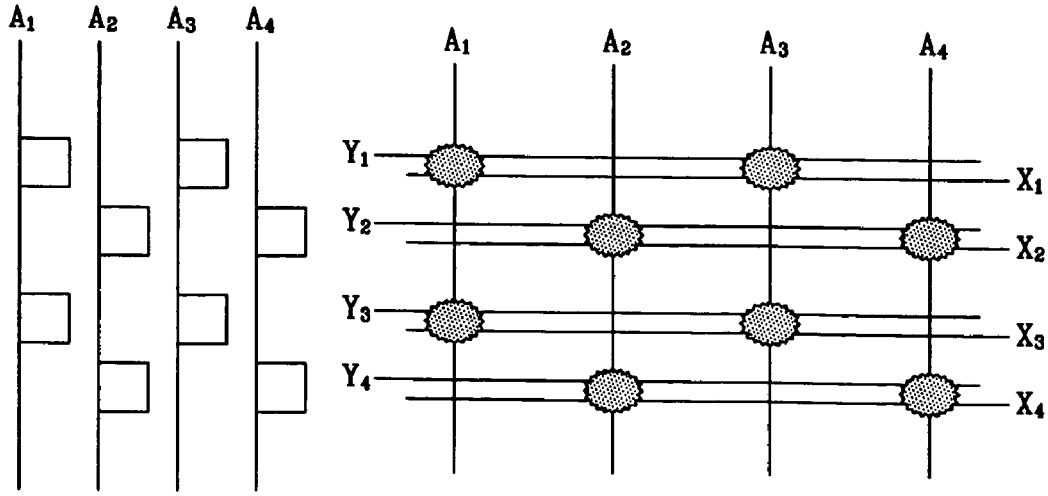
FIG. 6 shows a diagram of a dot on/off pattern.
Figure 7:
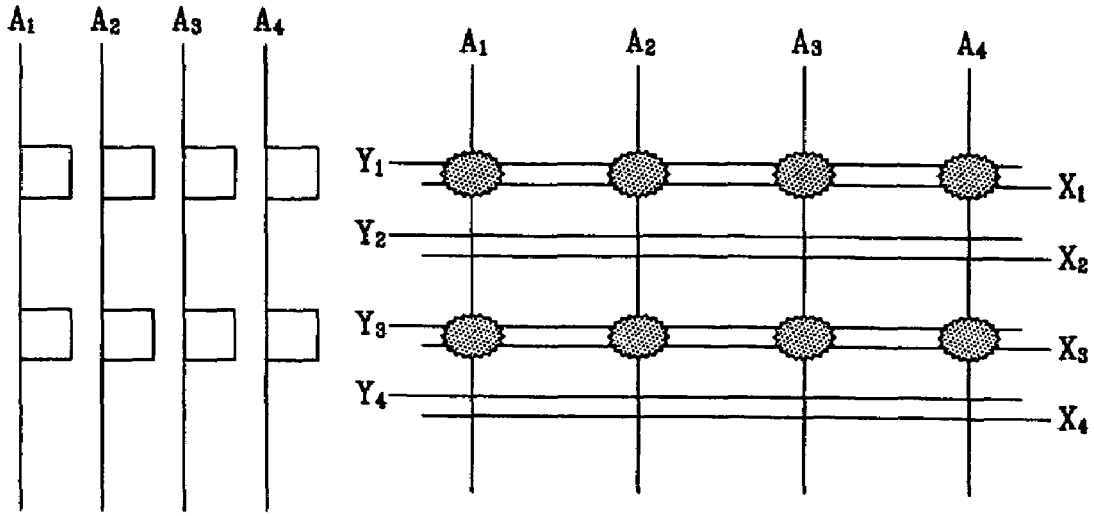
FIG. 7 shows a diagram of a line on/off pattern.
Figure 8:
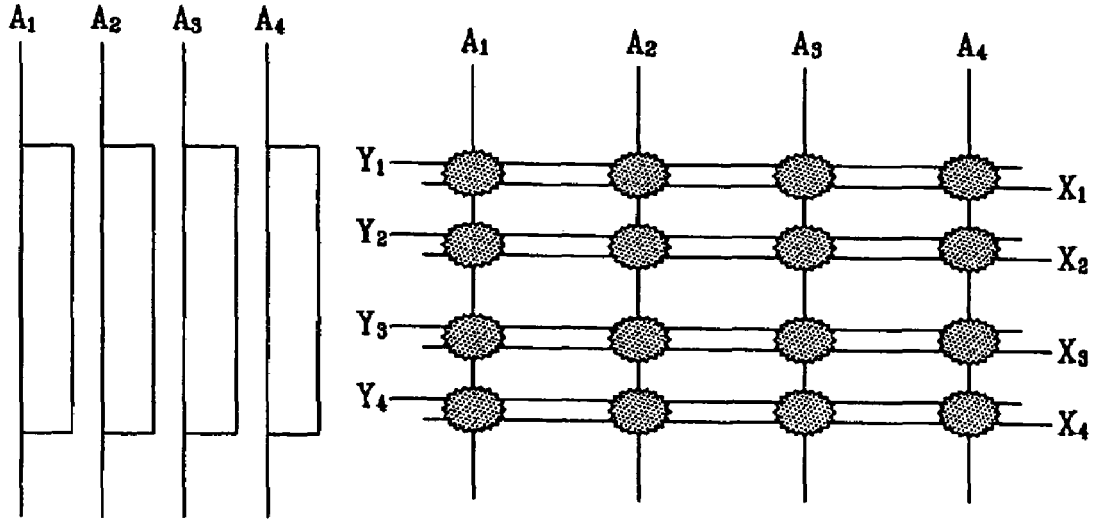
FIG. 8 shows a diagram of a full white pattern.

FIGS. 6 to 8 respectively show concept diagrams of the dot on/off pattern, the line on/off pattern, and the full white pattern.

These patterns are determined by a switching operation of the address selecting circuits 2201 to 220*m*. The driving timing of the switches Aa and Aerc of the power recovery circuit 210 may be the same in any case of realizing the patterns. The switching variation of the address selecting circuit represents an operation in which turn-on and turn-off operations of the switches AH and AL of the address selecting circuit are repeated when the scan electrodes are sequentially selected. That is, when the scan electrodes are sequentially selected, many switching variations of the address selecting circuit are generated if the address voltage and the ground voltage are alternately applied to the address electrode.

Referring to FIG. 6, the dot on/off pattern is a display pattern generated when the address voltage is alternately applied to the odd and even address electrodes where the scan electrodes are sequentially selected. For example, the address voltage is applied to the odd address electrodes A1 and A3 to select odd columns of the first row when the first scan electrode Y1 is selected, and the address voltage is applied to the even address electrodes A2 and A4 to select emission in the even columns of the second row when the second scan electrode Y2 is selected. That is, the switch AH of the odd address selecting circuit is turned on and the switch AL of the even address selecting circuit is turned on when the scan electrode Y1 is selected. The switch AH of the even address selecting circuit is turned on and the switch AL of the odd address selecting circuit is turned on when the scan electrode Y2 is selected.

Referring to FIG. 7, the line on/off pattern is a display pattern generated when the address voltage is applied to all the address electrodes A1 to A4 when the first scan electrode Y1 is selected, and ground voltage is applied to the address electrodes A1 to A4 when the second scan electrode Y2 is selected. That is, the switches AH of all the address selecting circuits are turned on when the scan electrode Y1 is selected, and the switches AL of all the address selecting circuits are turned on when the scan electrode Y2 is selected.

Referring to FIG. 8, the full white pattern is a display pattern generated when the address voltage is continuously applied to all the address electrodes when the scan electrodes are sequentially selected. That is, the switches AH of all the address selecting circuits are always turned on.

The switches AL of the address selecting circuits are periodically turned on in the dot on/off pattern and the line on/off pattern, but the switches AL are not turned on in the full white pattern. The turn-on states of the switch AL determine the voltage at the capacitor C2 in the power recovery circuit of FIG. 5.

An operation of the address driving circuit of FIG. 5 will be described in detail by exemplifying the dot on/off pattern and the full white pattern, since the dot on/off pattern and the line on/off pattern perform similar functions in that the switches AL are periodically turned on.

A temporal operation variation of the address driving circuit for displaying a pattern with many switching variations of the address selecting circuits 2201 to 220*m* as to the dot on/off pattern case will now be described with reference to FIGS. 9 and 10A to 10H. The operation variation has eight sequential modes M1 to M8, and the modes are varied by a manipulation of the switches. A resonance phenomenon is not a continuous oscillation, but a voltage and current variation caused by the combination of an inductor L and a panel capacitor Cp1 or Cp2 when the switch Aerc is turned on.

Figure 9:
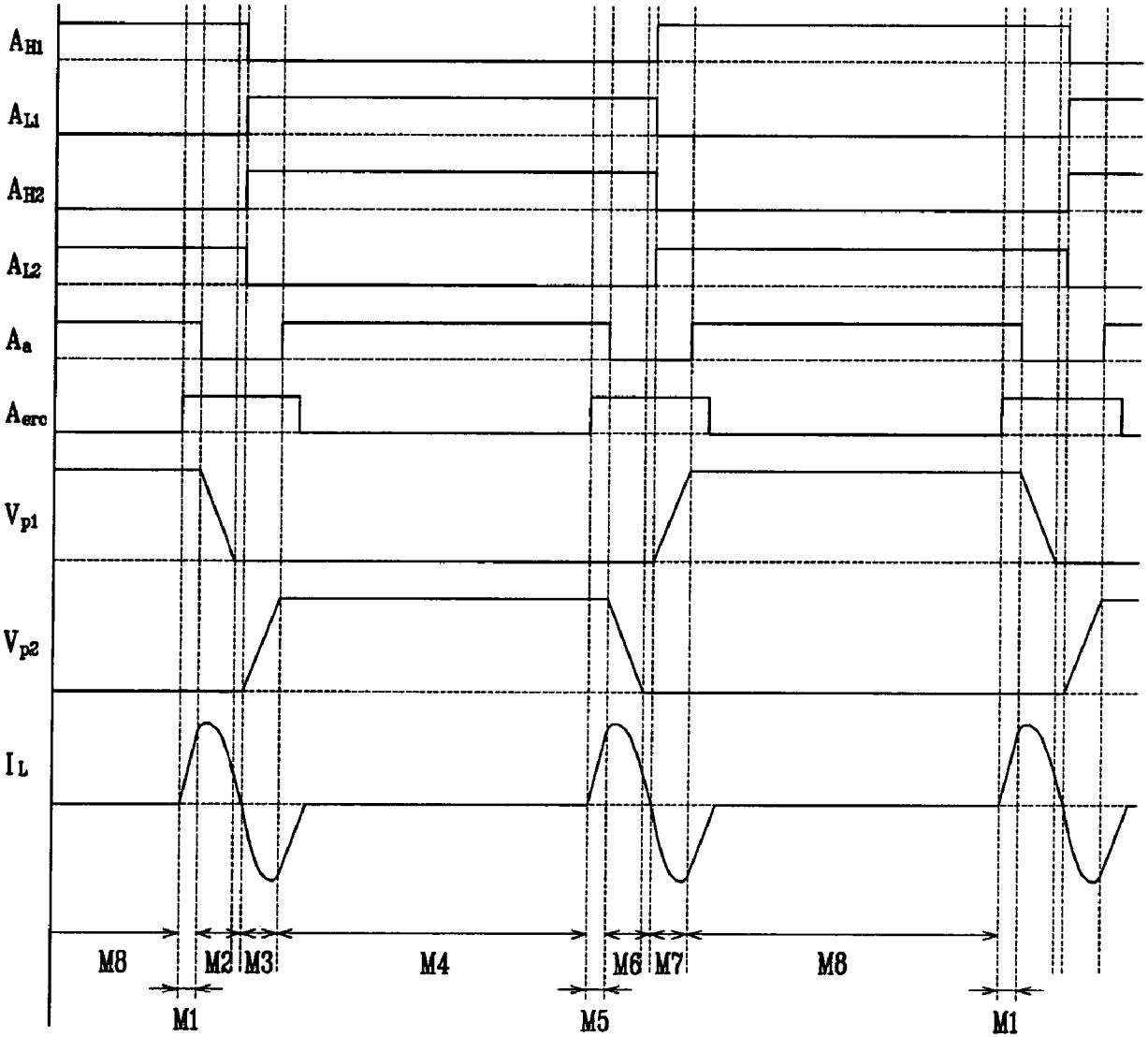
FIG. 9 shows a driving timing diagram of a power recovery circuit of FIG. 5 for showing the dot on/off pattern.

FIG. 9 shows a driving timing diagram of a power recovery circuit of FIG. 5 for showing the dot on/off pattern. FIGS. 10A to 10H show current paths for respective modes of the address driving circuit of FIG. 5 following the driving timing of FIG. 9.

When the dot on/off pattern is displayed in the circuit of FIG. 5, the switch AH1 of the address selecting circuit 2202*i* -1 connected to the odd address electrode A2*i* -1 and the switch AL2 of the address selecting circuit 2202*i* connected to the even address electrode A2*i* are turned on. The switch AH2 of the address selecting circuit 2202*i* and the switch AL1 of the address selecting circuit 2202*i*-1 are turned off when a single scan electrode is selected. The switches AH1 and AL2 are turned off and the switches AH2 and AL1 are turned on when the next scan electrode is selected. These operations are repeated. When the dot on/off pattern is displayed as described above, the switches AH1 and AH2 and the switches AL1 and AL2 of the address selecting circuits 2202*i* -1 and 2202*i* are continuously turned on/off by synchronizing with the scan voltage sequentially applied to the scan electrodes.

It is assumed in FIG. 9 that the switches AH1, AL2, and Aa are turned on and the switches AH2 and AL1 are turned off before the first mode M1 starts, so that the voltage of Va is applied to the panel capacitor Cp1 and the voltage of 0V is applied to the panel capacitor Cp2. That is, it is assumed that the voltage of Va is applied to the odd address electrode A2*i* -1 and the voltage of about 0V is applied to the even address electrode A2*i*.

Figure 10A:
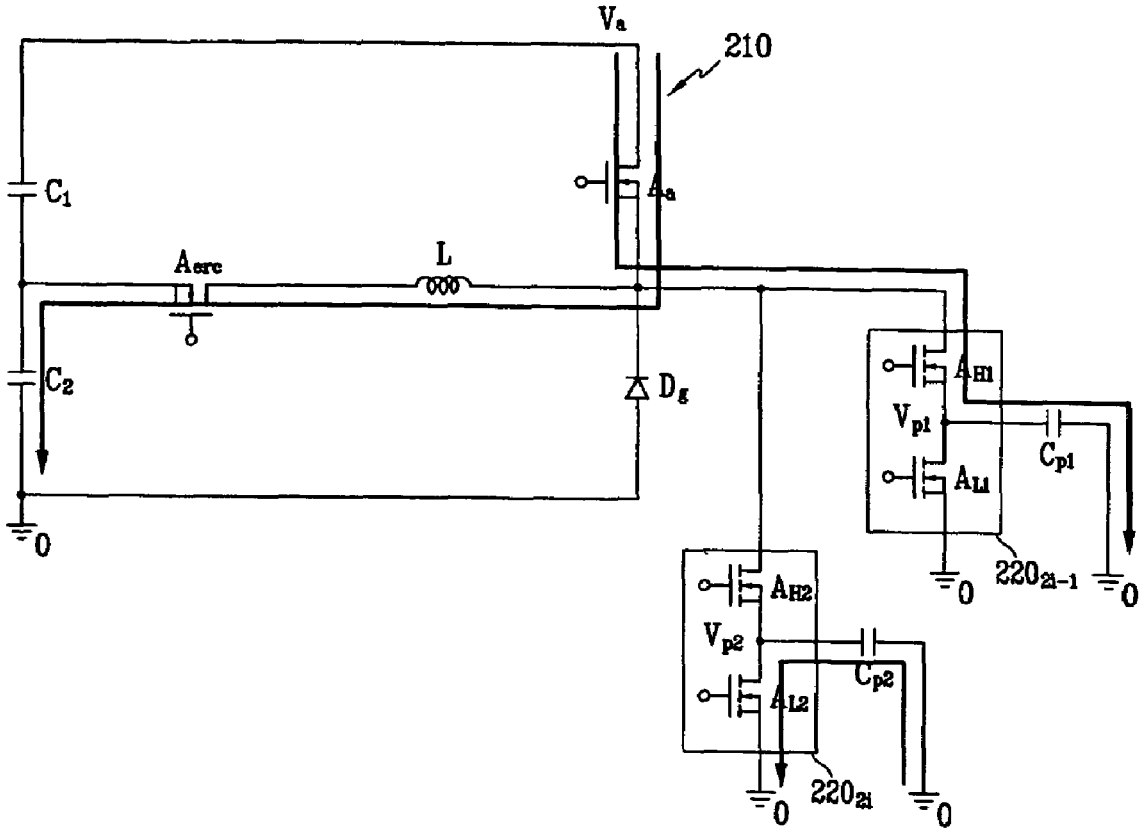
FIGS. 10A to 10H show current paths for respective modes of the address driving circuit of FIG. 5 following the driving timing of FIG. 9.

In first mode M1, the switch Aerc is turned on while the switches AH1, AL2, and Aa are on and the switches AH2 and AL1 are off. During the first mode M1, as shown in FIG. 10A, the current is injected to the inductor L and the capacitor C2 through the path of the voltage source Va, the switch Aa, the inductor L, the switch Aerc, and the capacitor C2, and the capacitor C2 is charged with a voltage. A current flowing to the inductor L linearly increases with a slope of (Va−V2)/L. In addition, the voltage of Va is applied to the panel capacitor Cp1, and the voltage of about 0V is applied to the panel capacitor Cp2 by the turn-on of the switches AH1 and AL2.

Figure 10B:
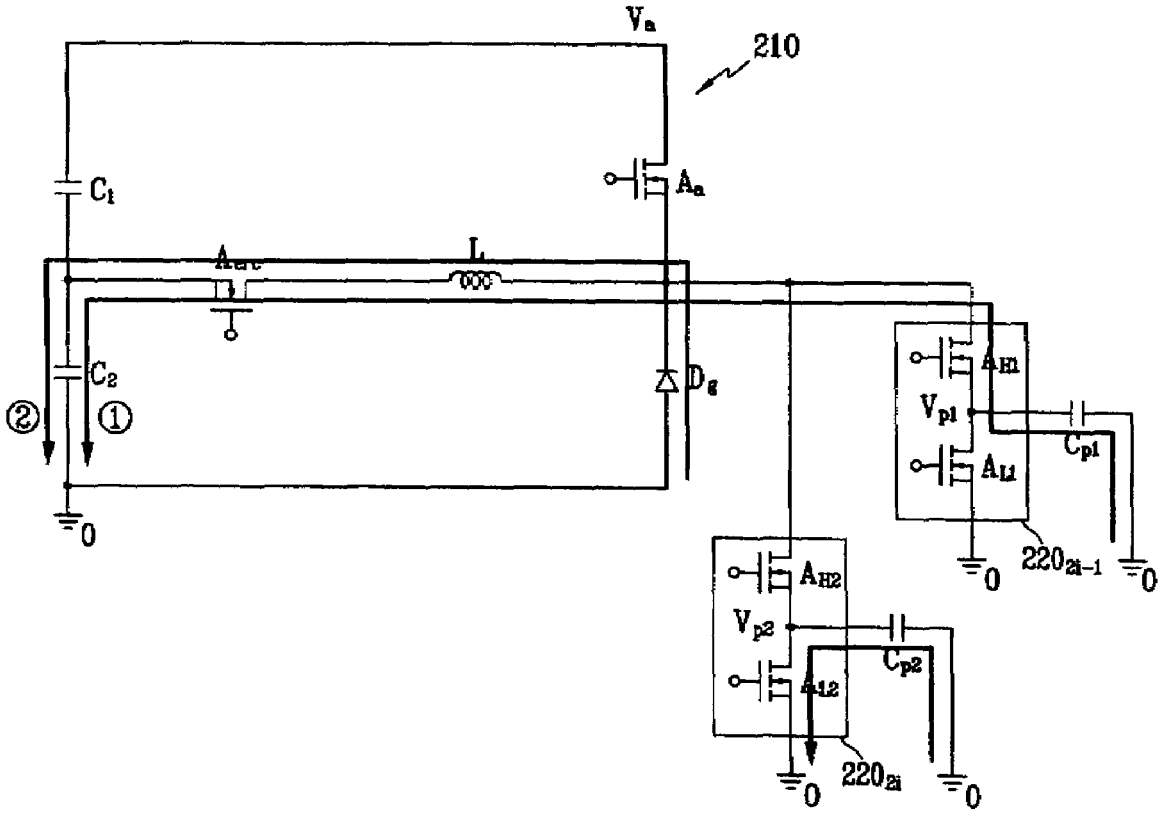

In second mode M2, the switch Aa is turned off to form a resonance path (1) in the order of the panel capacitor Cp1, the body diode of the switch AH1, the inductor L, the switch Aerc, and the capacitor C2, as shown in FIG. 10B. The panel capacitor Cp1 is discharged by the resonance current IL of the positive direction so that the voltage Vp1 of the panel capacitor Cp1 is reduced. The resonance current IL discharged from the panel capacitor Cp1 is supplied to the capacitor C2, and the capacitor C2 is charged with a voltage. In addition, the voltage Vp2 of the panel capacitor Cp2 is maintained at 0V since the switch AL2 is turned on. Furthermore, the voltage Vp1 of the panel capacitor Cp1 does not exceed the voltage of about 0V since the body diode of the switch AL1 coupled to the panel capacitor Cp1 or the diode Dg coupled to the ground voltage is turned on when the voltage Vp1 of the panel capacitor Cp1 is lower than the voltage of 0V.

In the mean time, the voltage Vp1 of the panel capacitor Cp1, at the time where the resonance current IL of the positive direction is about 0 A, is different than the voltage V2 of the capacitor C2. That is, the voltage Vp1 of the panel capacitor Cp1 cannot be reduced to about 0V by the current in the positive direction when the voltage V2 of the capacitor C2 is high. However, the voltage Vp1 of the panel capacitor Cp1 can be reduced to about 0V when the current in the positive direction is flowing when the voltage V2 of the capacitor C2 is low. If the current in the positive direction remains in the inductor L at the time where the voltage Vp1 of the panel capacitor Cp1 is about 0V, the remaining current of the positive direction is recovered to the capacitor C2 through the path (2) of the diode Dg, the inductor L, the switch Aerc and the capacitor C2. However, when the voltage Vp1 of the panel capacitor Cp1 is not reduced to about 0V, the residual voltage of the panel capacitor Cp1 is discharged at the time where the switch AL1 is turned in the third mode M3 described below.

Figure 10C:
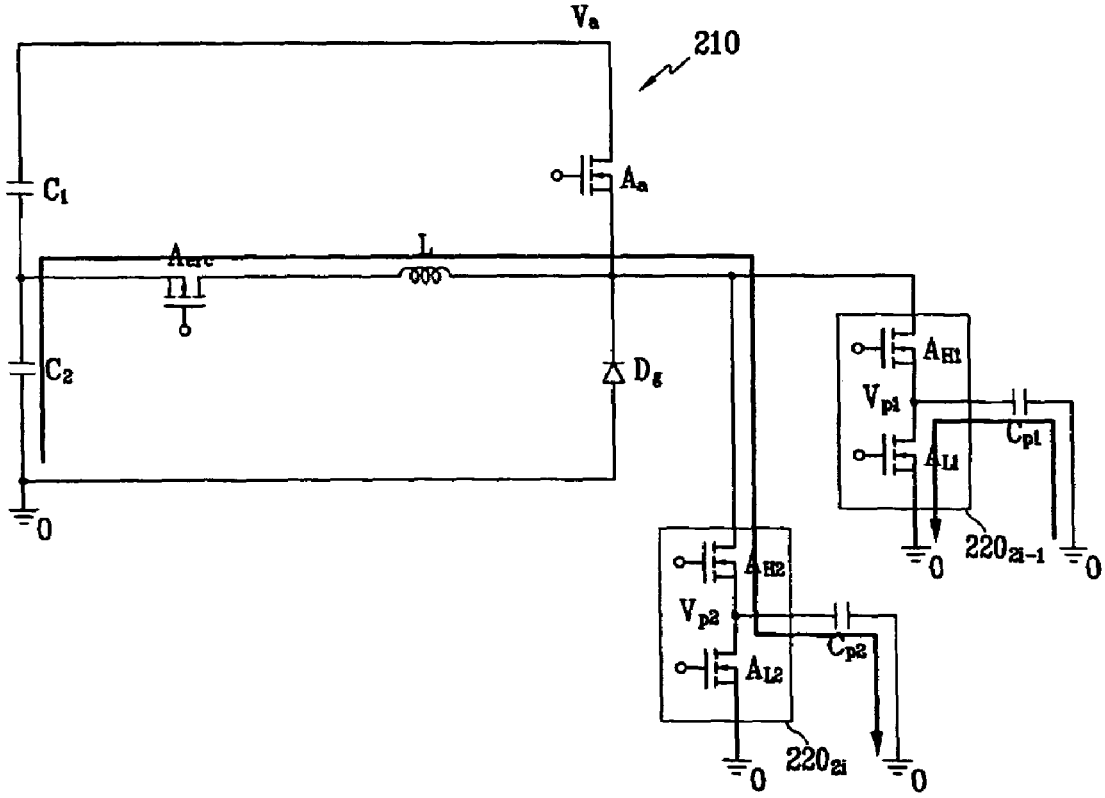

In the third mode M3, the switches AH1 and AL2 are turned off and the switches AH2 and AL1 are turned on to select the address electrode A2*i* and not to select the address electrode A2*i* -1. The voltage of about 0V is applied to the panel capacitor Cp1 through the switch AL1. As described above, when the voltage Vp1 of the panel capacitor Cp1 is higher than the voltage of about 0V, the residual voltage of the panel capacitor Cp1 is discharged through the switch AL1. In addition, when the resonance current IL is about 0 A, the current flows in the negative direction through the body diode of the switch Aerc by the resonance phenomenon. As shown in FIG. 10C, the resonance current IL of the negative direction flows through the path of the capacitor C2, the body diode of the switch Aerc, the inductor L, the switch AH2, and the panel capacitor Cp2. This current in the negative direction allows the panel capacitor Cp2 to be charged, so that the voltage Vp2 of the panel capacitor Cp2 increases. The voltage Vp2 of the panel capacitor Cp2 does not exceed the voltage of Va since the body diode of the switch Aa is turned on when the voltage Vp2 of the panel capacitor Cp2 exceeds the voltage of Va.

Figure 10D:
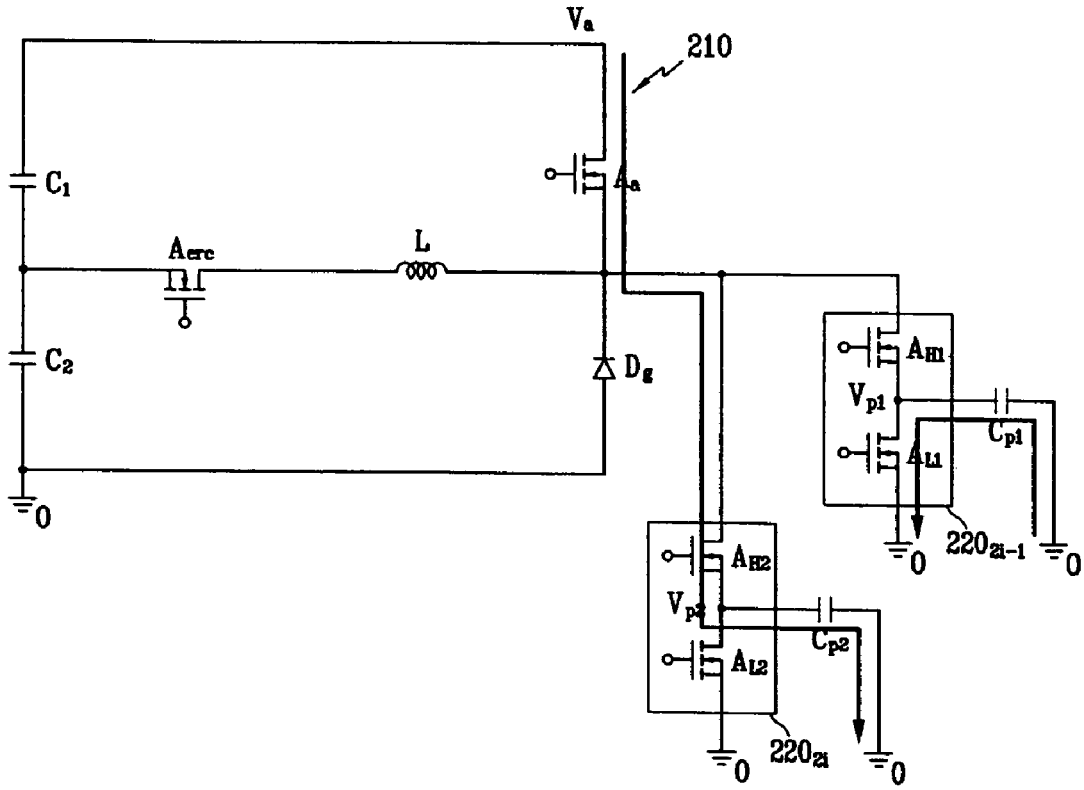

At or during the fourth mode M4, the switch Aa is turned on and the switch Aerc is turned off to apply the voltage of Va to the panel capacitor Cp2, as shown in FIG. 10D. In addition, the current remaining in the inductor L when the voltage of the panel capacitor Cp2 reaches the voltage of Va is recovered to the voltage source Va through the path of the capacitor C2, the body diode of the switch Aerc, the inductor L, and the body diode of the switch Aa.

In the third and fourth modes M3 and M4, the voltage V2 of the capacitor C2 is reduced, since the resonance current for charging the panel capacitor Cp2 and the current recovered to the voltage source Va are the current discharged from the capacitor C2.

Through the first through fourth modes M1 to M4 as described, the power recovery circuit 210 supplies the voltage of Va to the address electrode A2*i* through the switch AH2 of the address selecting circuit 2202*i*. In addition, the voltage of 0V is applied to the address electrode A2*i* -1 through the switch AL1 of the address selecting circuit 2202*i*-1.

Next, in the fifth through eight modes M5 to M8, the operation of the switches Aa and Aerc of the power recovery circuit is the same as that described above, except for the operation of the switches AH1, AH2, AL1, and AL2 of the address selecting circuit.

Figure 10E:
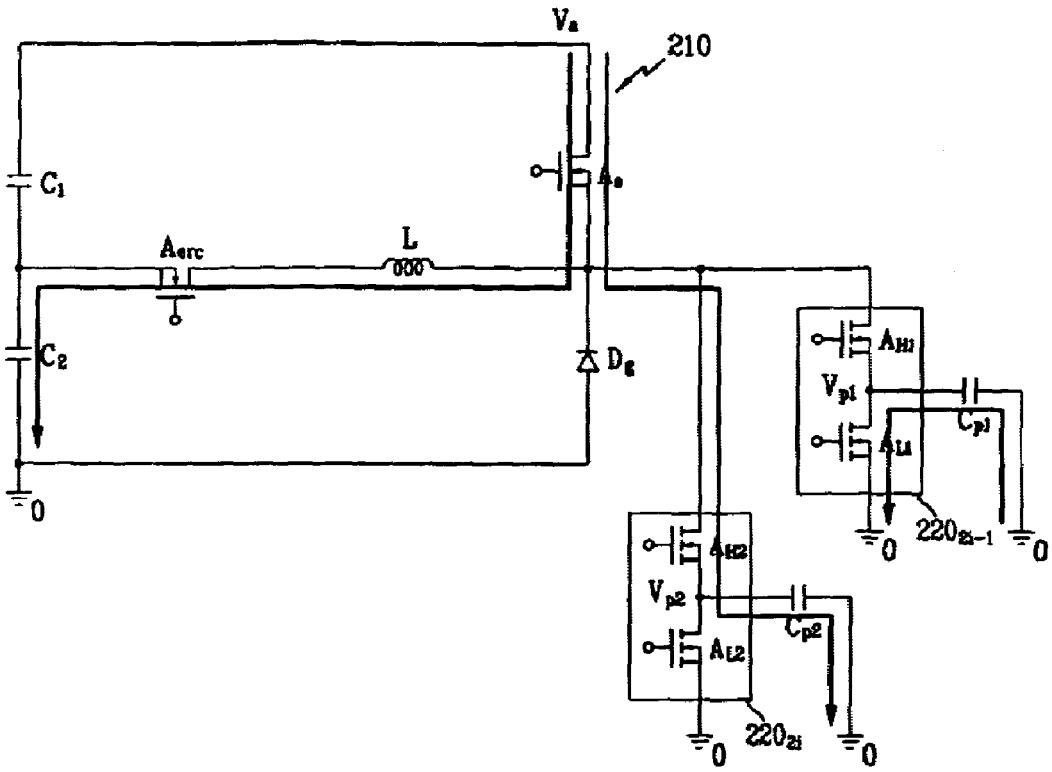

In the fifth mode M5, the switch Aerc is turned on while the switches AH2, AL1, and Aa are on and the switches AH1 and AL2 are off. Hence, the current is injected to the inductor L and the capacitor C2 through the path of the voltage source Va, the switch Aa, the is inductor L, the switch Aerc and the capacitor C2 as shown in FIG. 10E. The capacitor C2 is charged with a voltage. The current IL flowing to the inductor L linearly increases with a slope of (Va−V2)/L. In addition, the voltage of 0V is applied to the panel capacitor Cp2, and the voltage of Va is applied to the panel capacitor Cp1.

Figure 10F:
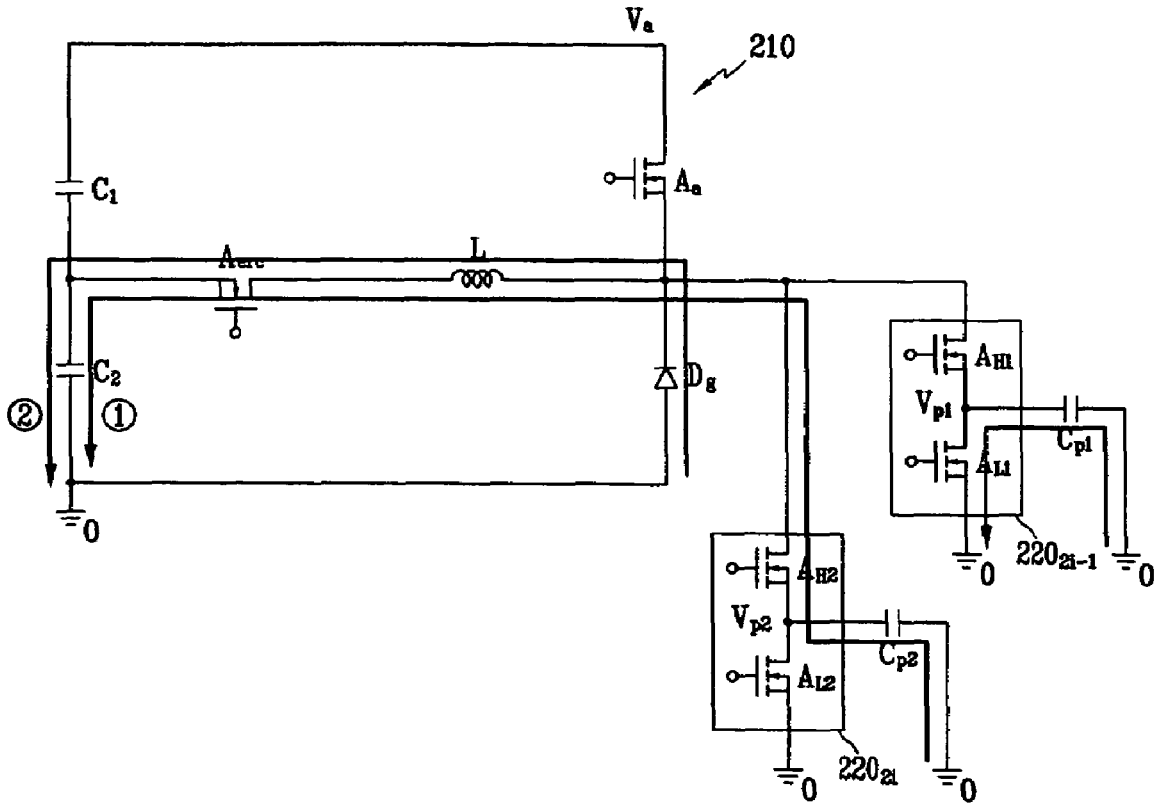

In the sixth mode M6, the switch Aa is turned off to form a resonance path (1) in the order of the panel capacitor Cp2, the body diode of the switch AH2, the inductor L, the switch Aerc, and the capacitor C2 as shown in FIG. 10F. The panel capacitor Cp2 is discharged by the current IL in the positive direction on the resonance path ① so that the voltage Vp2 of the panel capacitor Cp2 is reduced. The resonance current discharged from the panel capacitor Cp2 is supplied to the capacitor C2, and the capacitor C2 is charged with a voltage. In addition, the voltage Vp1 of the panel capacitor Cp1 is maintained at 0V since the switch AL1 is turned on. Furthermore, the voltage Vp2 of the panel capacitor Cp2 does not exceed the voltage of about 0V due to the body diode of the switch AL2 coupled to the panel capacitor Cp1 or the diode Dg coupled to the ground voltage.

As described in the second mode M2, the voltage Vp2 of the panel capacitor Cp2 at the time where the resonance current IL of the positive direction is about 0 A is different according to the voltage V2 of the capacitor C2. If the current of the positive direction remains in the inductor L at the time where the voltage Vp2 of the panel capacitor Cp2 is about 0V, the remaining current of the positive direction is recovered to the capacitor C2 through the path (2) of the diode Dg, the inductor L, the switch Aerc and the capacitor C2. However, when the voltage Vp2 of the panel capacitor Cp2 is not reduced to about 0V, the residual voltage of the panel capacitor Cp2 is discharged at the time where the switch AL2 is turned in the seventh mode M7 described below.

Figure 10G:
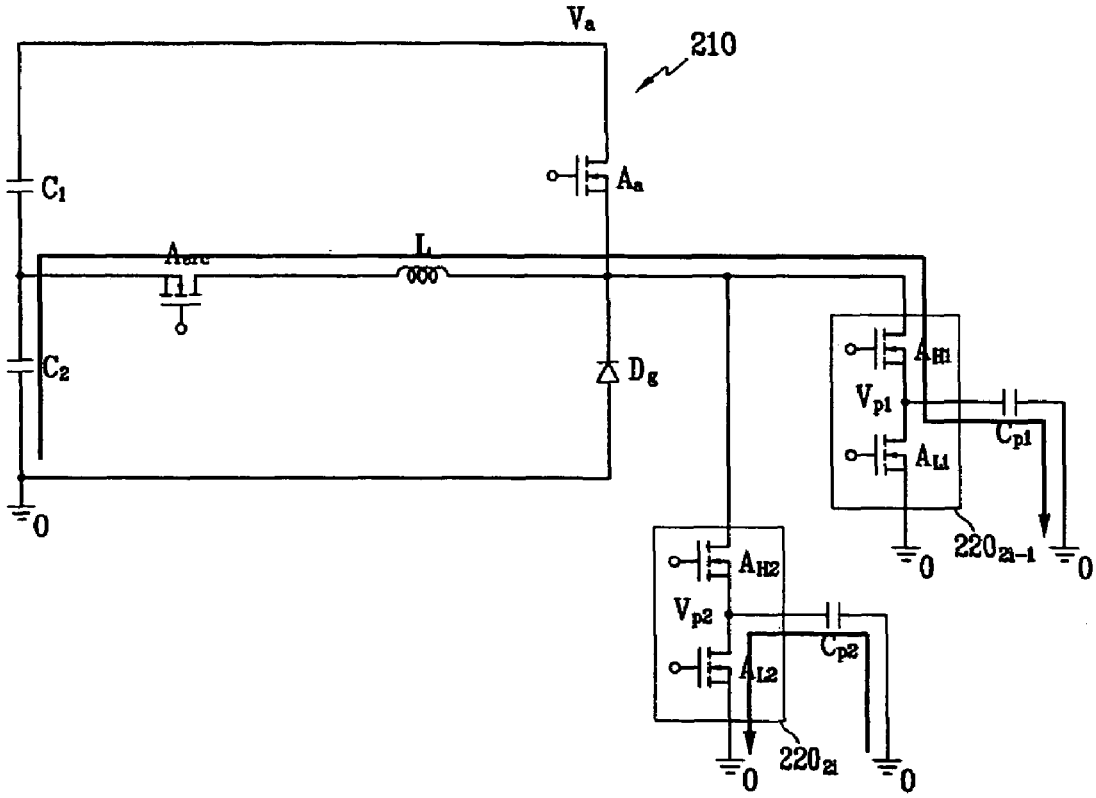

In the seventh mode M7, the switches AH2 and AL1 are turned off and the switches AH1 and AL2 are turned on, so as not to select the address electrode A2*i* and to select the address electrode A2*i* -1. The voltage of about 0V is applied to the panel capacitor Cp2 through the switch AL2. When the voltage Vp2 of the panel capacitor Cp2 is higher than the voltage of about 0V, the residual voltage of the panel capacitor Cp2 is discharged through the switch AL2. As described in the third mode M3, the resonance current IL flows through the path of the capacitor C2, the body diode of the switch Aerc, the inductor L, the switch AH1, and the panel capacitor Cp1, as shown in FIG. 10G. This current in the negative direction allows the panel capacitor Cp1 to be charged so that the voltage Vp1 of the panel capacitor Cp1 increases. The voltage Vp1 of the panel capacitor Cp1 does not exceed the voltage of Va by the body diode of the switch Aa.

Figure 10H:
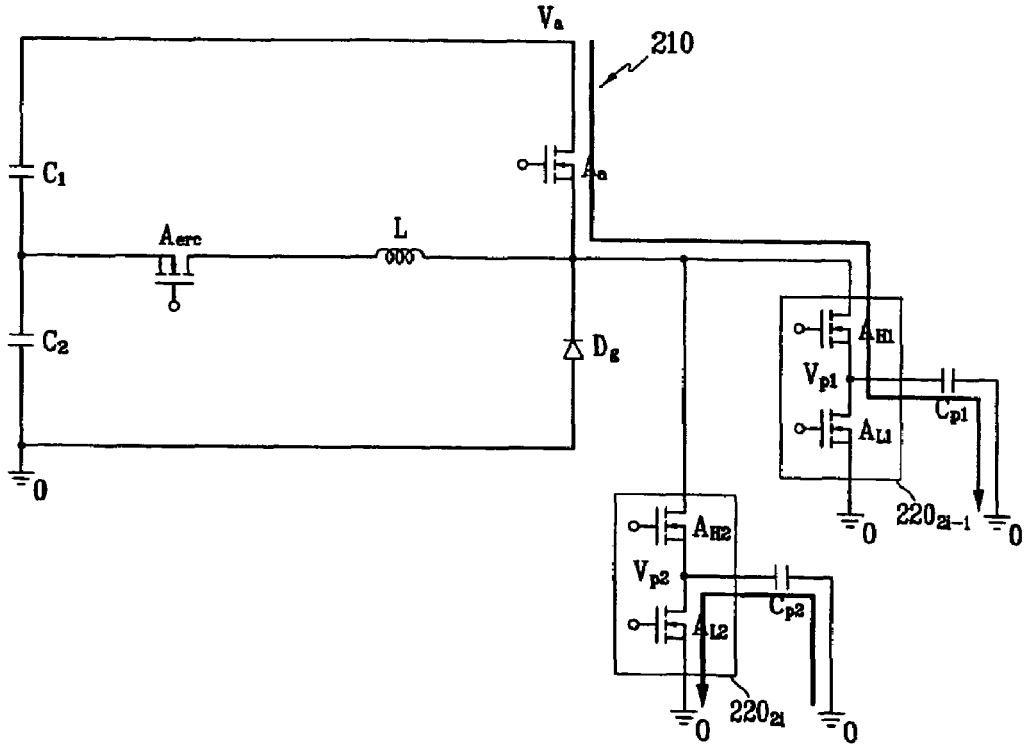

At or during the eighth mode M8, the switch Aa is turned on and the switch Aerc is turned off to apply the voltage of Va to the panel capacitor Cp1, as shown in FIG. 10H. In addition, the current remaining in the inductor L when the voltage of the panel capacitor Cp1 reaches the voltage of Va is recovered to the voltage source Va through the path of the capacitor C2, the body diode of the switch Aerc, the inductor L, and the body diode of the switch Aa.

In seventh and eighth modes M7 and M8, the voltage V2 of the capacitor C2 is reduced, since the resonance current for charging the panel capacitor Cp1 and the current recovered to the voltage source Va are the current discharged from the capacitor C2.

Through the fifth to eighth modes M5 to M8 as described, the power recovery circuit 210 supplies the voltage of Va to the address electrode A2*i* -1 through the switch AH1 of the address selecting circuit 2202*i* -1. In addition, the voltage of about 0V is applied to the address electrode A2*i* through the switch AL2 of the address selecting circuit 2202*i*. The dot on/off pattern is realized by repeating the operation of first to eighth modes M1 to M8.

When the capacitor C2 is charged with a voltage of Va/2, and the capacitance of the capacitor C2 is large enough to function as a power for supplying the voltage of Va/2 to the capacitor C2, the panel capacitor Cp1 or Cp2 charged with the voltage of Va in the second or sixth mode M2 or M6 can be discharged to about 0V by the LC resonance principle, and the panel capacitor Cp1 or Cp2 discharged to 0V in the third or seventh mode M3 or M7 can be charged to the voltage of Va.

Next, the energy flow on the capacitor C2 will be described. First, the current (energy) is supplied to the capacitor C2 through the inductor L from the voltage source Va in the first mode M1, and the panel capacitor Cp1 is discharged to supply the current (energy) to the capacitor C2 in the second mode M2. That is, the capacitor C2 is charged with the energy to raise the voltage of the capacitor C2 by an amount of ΔV1 in the first and second modes M1 and M2. The current is supplied from the capacitor C2 through the inductor L to increase the voltage Vp2 of the panel capacitor Cp2 and the residual current is recovered to the voltage source in the third mode M3. That is, the energy is discharged from the capacitor C2 to reduce the voltage of the capacitor C2 by the amount of Δ V2. Assuming that the capacitor C2 is charged with the voltage of Va/2 in the earlier stage, the charge energy of the capacitor C2 is greater than the discharge energy of the capacitor C2, since the energy is further supplied through the voltage source Va in the first mode M1 at the time of charging the capacitor C2. That is, Δ V1 is greater than Δ V2. The charge and discharge energy to and from the capacitor C2 in the fifth to eighth modes M5 to M8 corresponds to the charge and discharge energy in the first to fourth modes M1 to M4. Since the panel capacitor Cp1 or Cp2 is discharged, its residual voltage reaches about 0V, and the panel capacitor is charged again in the third or seventh mode M3 or M7, the energy discharged from the capacitor C2 for charging the panel capacitor Cp1 or Cp2 is substantially constant when the first to eighth modes M1 to M8 are repeated.

When the charge energy of the capacitor $C_2$ is greater than the discharge energy, and the voltage of the capacitor $C_2$ increases, the energy charged to the capacitor $C_2$ is reduced in the first and second modes M1 and M2 or the fifth and sixth modes M5 and M6. That is, when the operations of the first to eighth modes (M1 to M8) are repeatedly performed, the charge energy of the capacitor $C_2$ is reduced, and the charge energy of the capacitor $C_2$ and the discharge energy thereof finally become the same, to thus reach an equilibrium state. The voltage charged in the capacitor $C_2$ is greater than the voltage of $V_a/2$ and less than the voltage of Va.

When the voltage charged in the panel capacitor C2 is greater than the voltage of Va/2, the voltage which is twice the voltage of the capacitor C2, that is, the voltage of greater than the voltage of Va, can be charged in the panel capacitors Cp1 and Cp2 by the resonance principle in the third and seventh modes M3 and M7. Therefore, the voltages of the panel capacitors Cp1 and Cp2 can rise to the voltage of Va by the resonance when a parasitic component is provided in the address driving circuit, and the switch Aa can perform a zero-voltage switching operation.

A temporal operation variation of the address driving circuit for displaying full white a pattern with less switching variations of the address selecting circuits 2201 to 220*m* as to the line on/off pattern case will be described with reference to FIGS. 11 and 12A to 12D. The operation variation has four sequential modes M1 to M4, and the modes are varied by a manipulation of the switches. A resonance phenomenon is not a continuous oscillation, but a voltage and current variation caused by combination of an inductor L or L2 and a panel capacitor Cp1 or Cp2 when the switches Ar and Af are turned on.

Figure 11:
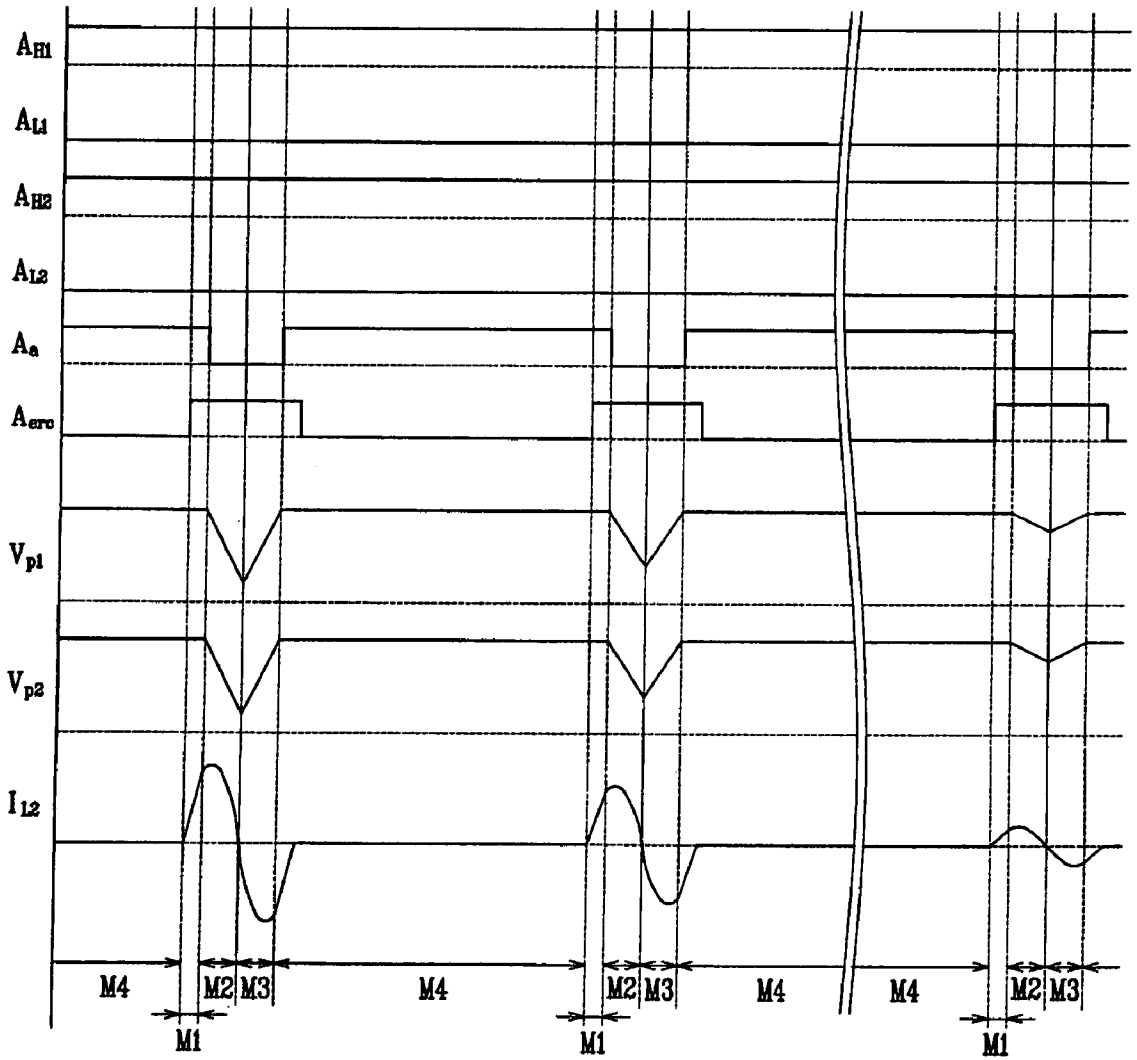
FIG. 11 shows a driving timing diagram of the power recovery circuit of FIG. 5 for showing the full white pattern.

FIG. 11 shows a driving timing diagram of a power recovery circuit of FIG. 5 for showing the full white pattern, and FIGS. 12A to 12D show current paths for respective modes of the address driving circuit of FIG. 5 following the driving timing of FIG. 11.

In the case of displaying the full white pattern in the circuit of FIG. 5, the switches AH1 and AH2 of the address selecting circuits 2202*i* -1 and 2202*i* are always turned on while the scan electrodes are sequentially selected.

It is assumed in FIG. 11 that the switches AH1, AH2, and Aa are turned on before the first mode M1 begins so that the voltage of Va is applied to the panel capacitors Cp1 and Cp2.

Figure 12A:
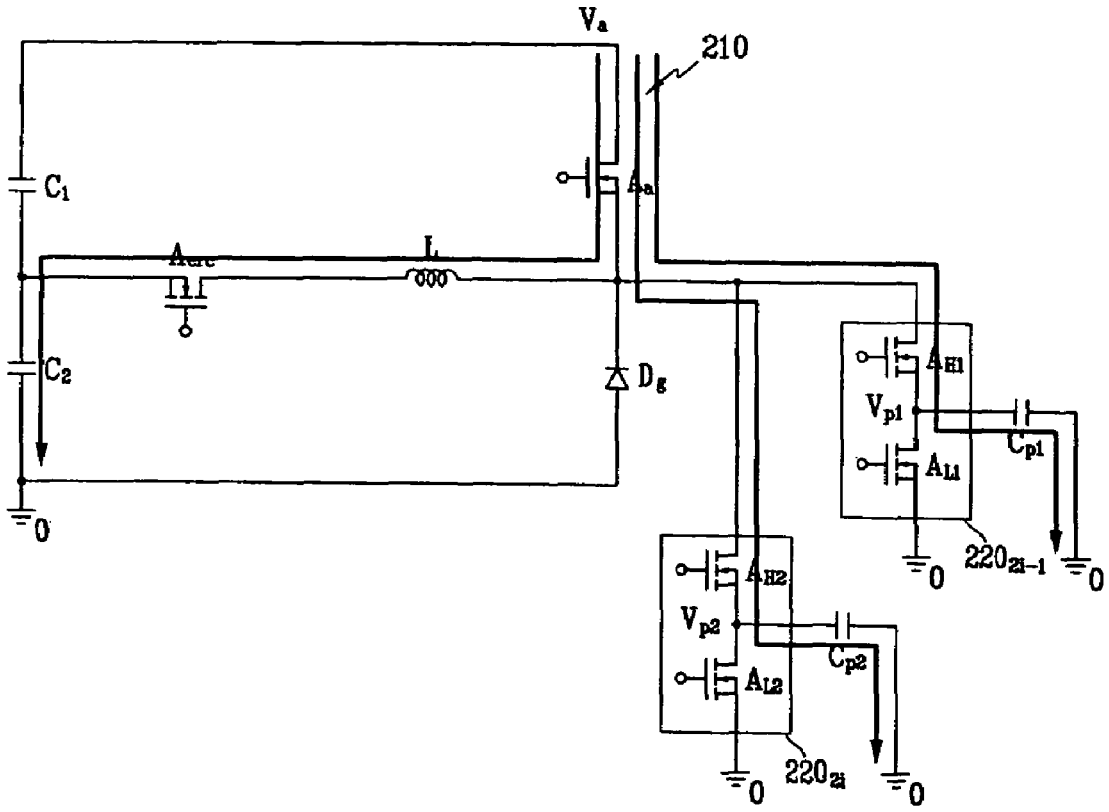
FIGS. 12A to 12D show current paths for respective modes of the address driving circuit of FIG. 5 following the driving timing of FIG. 11.

In mode 1 M1, the switch Aerc is turned on while the switches AH1, AH2, and Aa are on and the switches $AL_1$ and $AL_2$ are off. As shown in FIG. 12A, the current flowing in the inductor L linearly increases with the slope of (Va−V2)/L, and this current is injected to the inductor L and the capacitor C2 to charge the capacitor C2 with a voltage in the same manner as the first mode M1 of FIG. 9. In addition, the panel capacitors Cp1 and Cp2 are maintained at the voltage of Va.

Figure 12B:
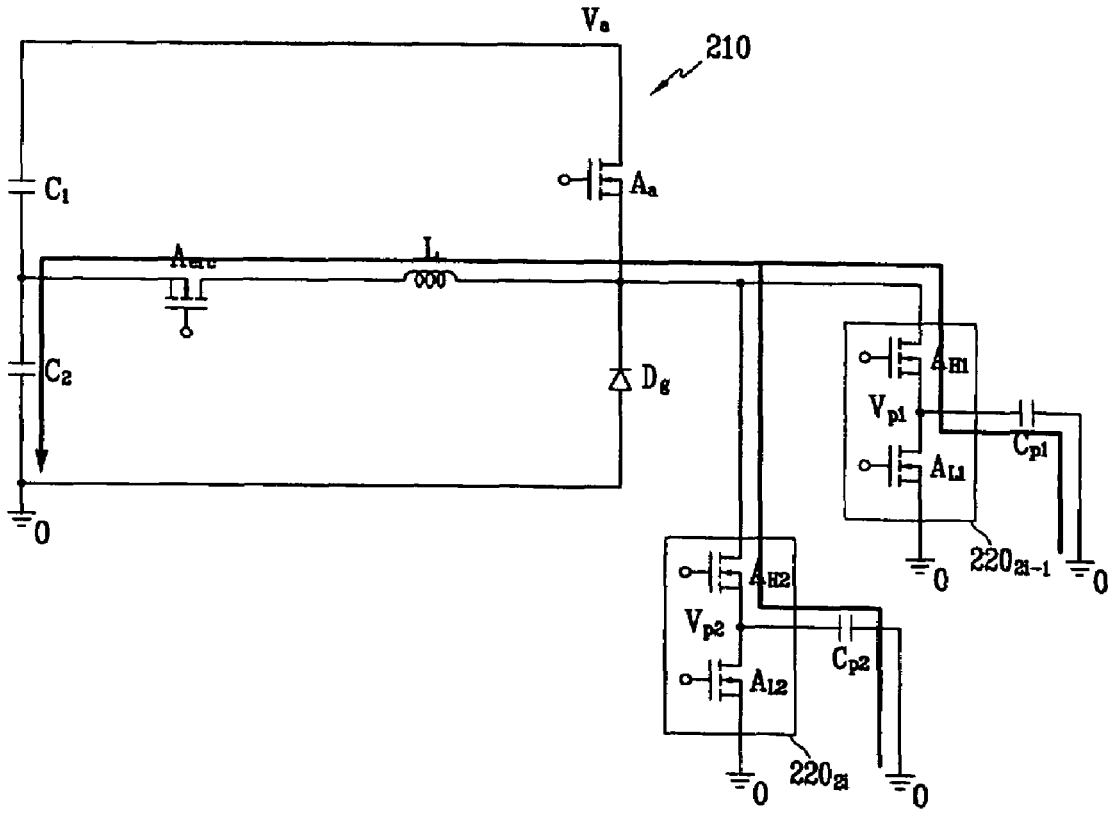

In the second mode M2, the switch Aa is turned off to form a resonance path in the order of the panel capacitors Cp1 and Cp2, body diodes of the switches AH1 and AH2, the inductor L, the switch Aerc, and the capacitor C2 as shown in FIG. 12B. The voltages Vp1 and Vp2 of the panel capacitors Cp1 and Cp2, are reduced by the resonance path, and the capacitor C2 is charged with a voltage in the same manner of the second mode M2 of FIG. 9. The voltages Vp1 and Vp2 of the panel capacitors Cp1 and Cp2 can be reduced to about 0V by the current in the positive direction, when the voltage V2 of the capacitor C2 is low. However, in the full white pattern, the voltages Vp1 and Vp2 of the panel capacitors Cp1 and Cp2 cannot be reduced to about 0V by the current of the positive direction since the voltage V2 of the capacitor C2 is high. This reason will be described below.

Figure 12C:
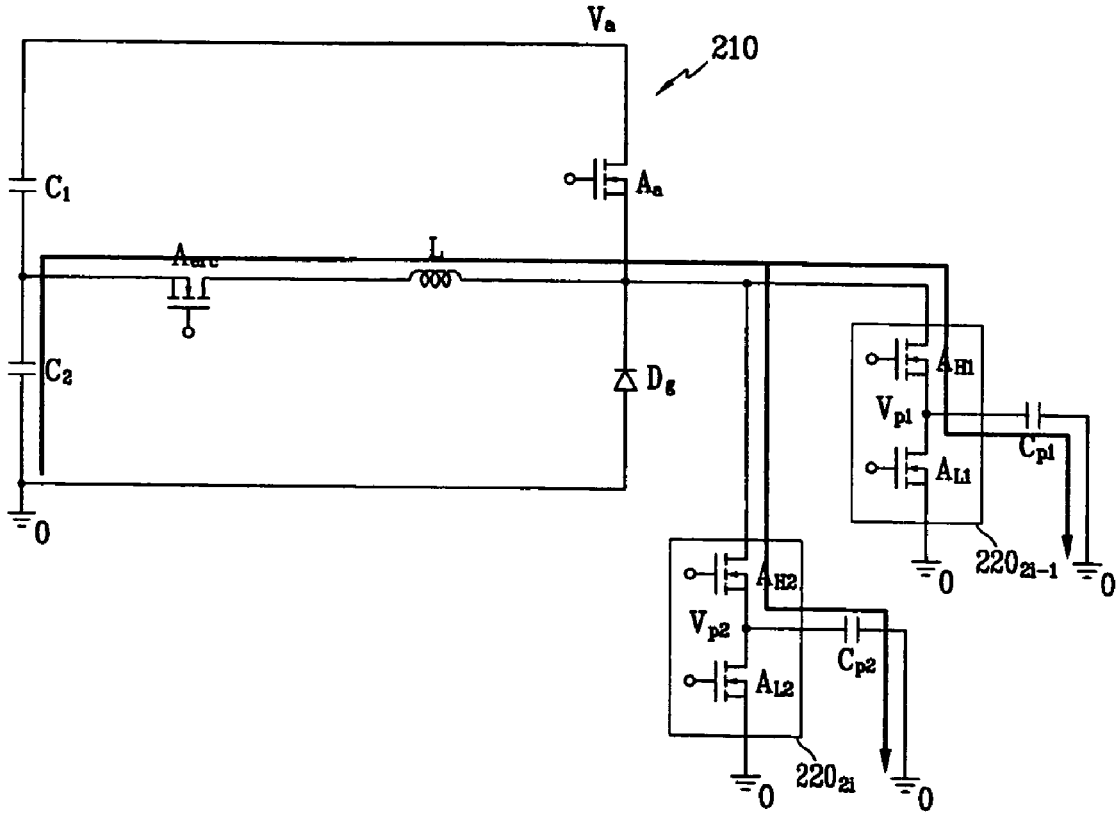

In the full white pattern, the switch AH1 and AH2 are continuously turned on, since the address electrodes A2*i*-1 and A2*i* are continuously selected when the scan voltage is sequentially applied to the scan electrodes Y1 to Yn. Accordingly, in the third mode M3 of the full white pattern, the switches AL1 and AL2 are not turned on differently from the dot on/off pattern. Hence, the residual voltages of the panel capacitors Cp1 and Cp2 are not discharged. In addition, when the resonance current IL is 0 A, the current flows in the negative direction through the body diode of the switch Aerc by the resonance phenomenon. As shown in FIG. 12C, the resonance current IL flows through the path of the capacitor C2, the body diode of the switch Aerc, the inductor L, the switches AH1 and AH2, and the panel capacitors Cp1 and Cp2. By this current in the negative direction, the voltages Vp1 and Vp2 of the panel capacitors Cp1 and Cp2 increase, and the capacitor C2 is discharged. The voltages Vp1 and Vp2 of the panel capacitors Cp1 and Cp2 do not exceed the voltage of Va since the body diode of the switch Aa is turned on when the voltages Vp1 and Vp2 of the panel capacitors Cp1 and Cp2 exceed the voltage of Va.

Figure 12D:
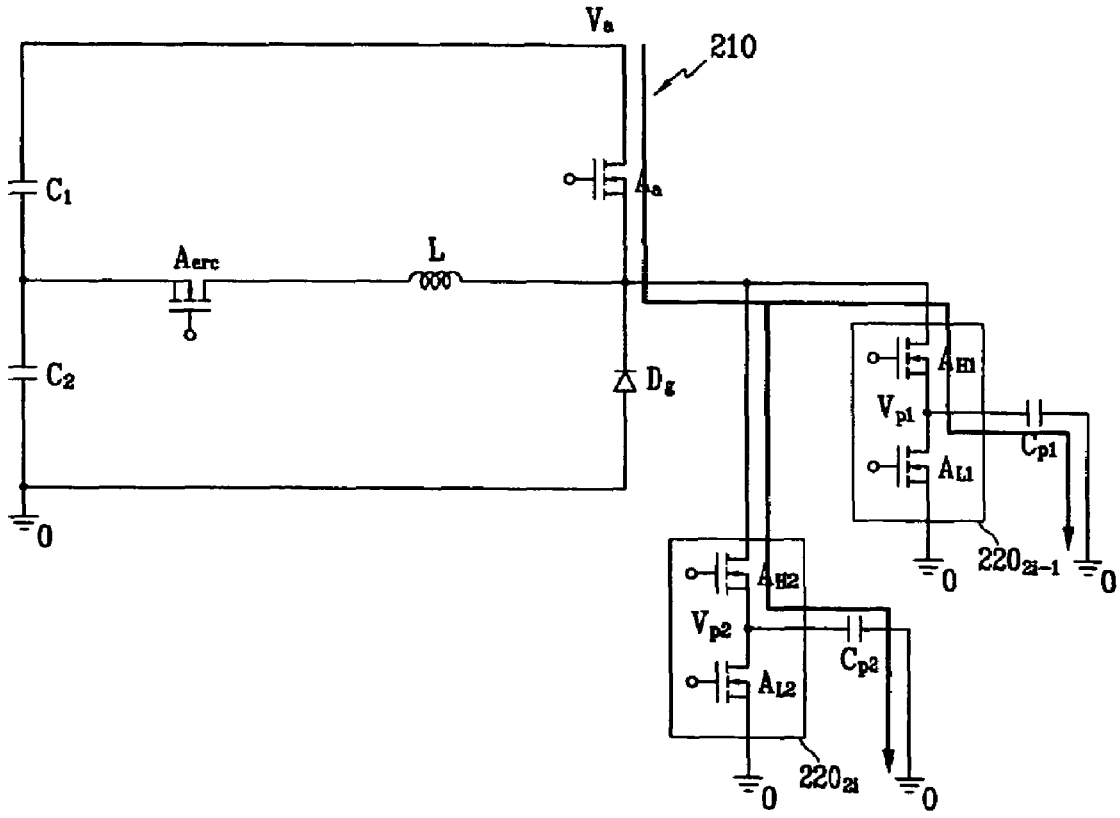

At or during the fourth mode M4, the switch Aa is turned on and the switch Aerc is turned off to apply the voltage of Va to the panel capacitors Cp1 and Cp2, as shown in FIG. 12D. In addition, the current remaining in the inductor L when the voltage of the panel capacitors Cp1 and Cp2 reach the voltage of Va is recovered to the voltage source Va through the path of the capacitor C2, the body diode of the switch Aerc, the inductor L, and the body diode of the switch Aa.

Through the first to fourth modes M1 to M4, the power recovery circuit 210 supplies the voltage of Va to the address electrodes A2*i*-1 and A2*i* through the switches AH1 and AH2 of the address selecting circuits 2202*i*-1 and 2202*i* as described. In the case of displaying the full white pattern of FIG. 9, the first to fourth modes M1 to M4 are repeated while the switches AH1 and AH2 are turned on.

As described in the dot on/off pattern above, repeating the first to fourth modes M1 to M4 allows the voltage V2 of the capacitor C2 to increase in the full white pattern. When the voltage V2 of the capacitor C2 is high, so that the voltages Vp1 and Vp2 of the panel capacitors Cp1 and Cp2 is not reduced to about 0V, the residual voltages in the panel capacitors Cp1 and Cp2 are not discharged, since the switches AL1 and AL2 of the address electrodes A2*i*-1 and A2*i* are not turned on. Therefore, the panel capacitors Cp1 and Cp2 are charged again in the third mode M3, while the residual voltage is not discharged after the panel capacitors Cp1 and Cp2 are discharged in the second mode M2. Assuming that 100% of the energy is recovered and used, the energy of charging the capacitor C2 in the second mode M2 and the energy discharged from the capacitor C2 in the third mode M3 are substantially the same. However, the voltage Δ V1 charged in the capacitor C2 is always greater than the voltage Δ V2 discharged from the capacitor C2 when displaying the full white pattern of FIG. 8, since the operation of supplying the current to the capacitor C2 to charge the capacitor C2 in the first mode M1 is further performed.

The voltage V2 of the capacitor C2 increases when the processes of the first to fourth mode M1 to M4 are repeated when the voltage Δ V1 charged in the capacitor C2 is greater than the voltage Δ V2 discharged from the capacitor C2. When the voltage V2 of the capacitor C2 increases, the current discharged from the panel capacitors Cp1 and Cp2 to the capacitor C2 is reduced in second mode M2 to reduce the discharged amount from the panel capacitors Cp1 and Cp2. That is, the reducing amounts of the voltages Vp1 and Vp2 of the panel capacitors Cp1 and Cp2 are reduced when the first to fourth modes M1 to M4 are repeated, as shown in FIG. 11.

When the voltage of the capacitor C2 continuously increases to substantially correspond to the voltage of Va, the panel capacitors Cp1 and Cp2 are not discharged in the second mode M2, since the voltages Vp1 and Vp2 of the panel capacitors Cp1 and Cp2 correspond to the voltage V2 of the capacitor C2. In addition, the panel capacitors Cp1 and Cp2 are not charged in the third mode M3, since voltages Vp1 and Vp2 of the panel capacitors Cp1 and Cp2 are not reduced in the second mode M2. When the voltage V2 of the capacitor C2 reaches the voltage of Va, the substantial current movement almost disappears in the second and third modes M2 and M3. That is, the power recovery circuit 210 does not operate substantially in the case of displaying the full white pattern.

As described above, the operation of the power recovery circuit according to an first exemplary embodiment of the present invention is established when a voltage level of the capacitor C2 is varied by the switching operation of the address selecting circuit. The voltage of the capacitor C2 is determined by the energy charged in the capacitor C2 and the energy discharged from the capacitor C2. Since the charge energy of the capacitor C2 includes the energy supplied by the voltage source through an inductor and the discharge energy of the panel capacitor, and the discharge energy of the capacitor C2 includes the charge energy of the panel capacitor, the charge energy of the capacitor C2 is greater than the discharge energy thereof when the capacitor C2 is charged with the voltage which is the half voltage Va/2 of the address voltage.

In the case of the dot on/off pattern, since the panel capacitor charged up to the address voltage is completely discharged down to the ground voltage by the turn-on of the switch AL of the address selecting circuit and charged up again to the address voltage, the charge energy of the panel capacitor which is the discharge energy of the capacitor C2 is almost constant. In addition, the voltage of the capacitor C2 is increased, and the charge energy of the capacitor C2 is accordingly reduced, since the charge energy of the capacitor C2 is greater than the discharge energy thereof while the capacitor C2 is charged with a voltage of Va/2. Therefore, when the above operation is repeated, the charge energy of the capacitor C2 is reduced to substantially correspond to the discharge energy of the capacitor C2, thereby performing the power recovery operation.

That is, the capacitor C2 is charged with the voltage of between Va/2 and Va to perform the power recovery operation when many panel capacitors charged up to the address voltage after being completely discharged down to the ground voltage are provided from among a plurality of panel capacitors connected to the address selecting circuits 2201 to 220*m*, because of many switching variations of the address selecting circuits 2201 to 220*m*.

In the case of the full white pattern, the switch AL connected to the panel capacitor charged up to the address voltage is not turned on. When the charge energy of the capacitor C2 is greater than the discharge energy so that the voltage of the capacitor C2 becomes greater than the voltage of Va/2, the voltage of the panel capacitor is not discharged down to the ground voltage by the resonance of the inductor and the panel capacitor. A residual voltage is generated, since the switch AL connected to the panel capacitor charged up to the address voltage is not turned on. The charge energy and the discharge energy of the panel capacitor are reduced in the same manner by the residual voltage, and accordingly, the voltage of the capacitor C2 continuously increases. When the voltage of the capacitor C2 increases, the residual voltage of the panel capacitor also increases, almost no energy is charged in the panel capacitor and discharged from the same, and almost no energy is exhausted in the power recovery circuit.

The above-noted power recovery operation is rarely performed for a pattern where only one color is displayed on the whole screen, or a pattern where the address voltage is continuously applied to a predetermined amount of address electrodes in addition to the full white pattern.

In the above-described exemplary embodiment of the present invention, the power recovery operation is performed in the pattern that requires the power recovery operation because of many switching variations of the address selecting circuit, and no power recovery operation is automatically performed in the pattern that requires no power recovery operation because of few switching variations of the address selecting circuit. In addition, in the first exemplary embodiment of the present invention, since the voltage of the address electrode is changed only by the resonance current when the scan electrodes are sequentially selected, the address pulse has the short period. Therefore, the fast addressing is realized.

In the first exemplary embodiment of the present invention, the diode Dg is used to recover the current of the positive direction remaining in the inductor L after the voltage of the panel capacitor reaches about 0V. In addition, the current in the positive direction remaining in the inductor L can be recovered through the address selecting circuits 2202*i*-1 and 2202*i*. This exemplary embodiment will be described below with reference to FIG. 13.

Figure 13:
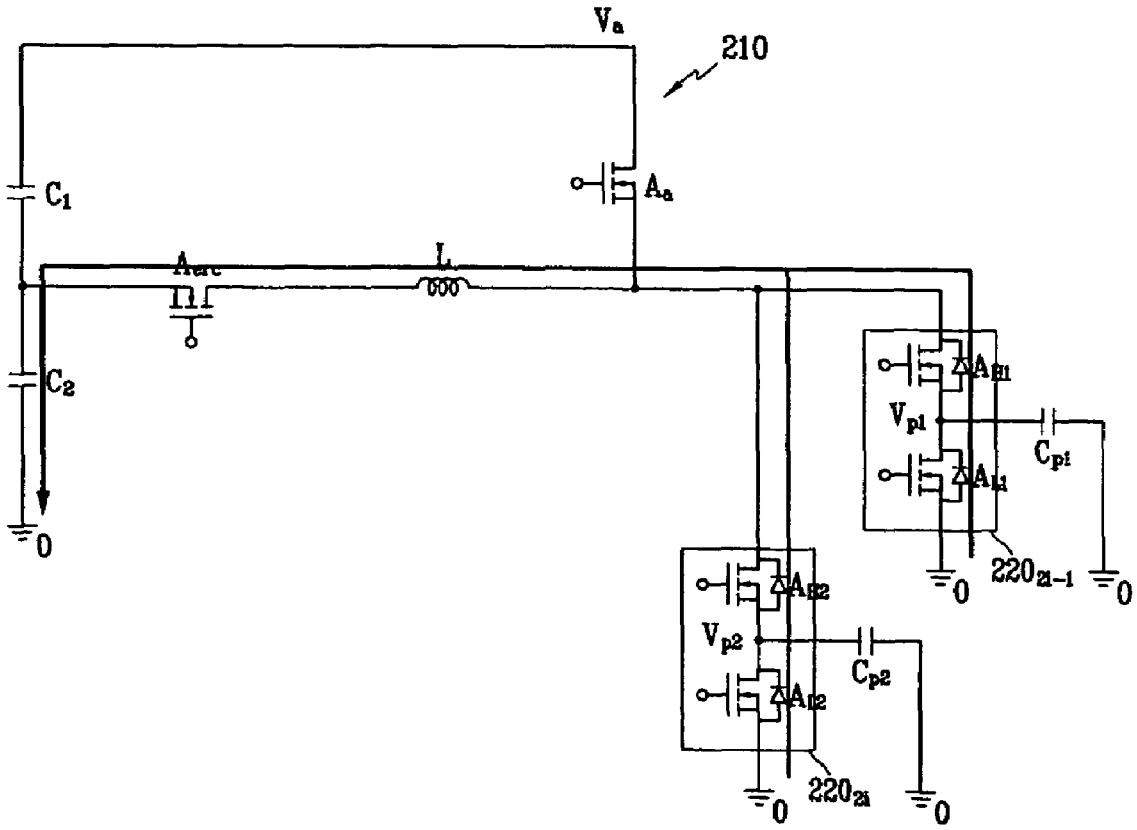
FIG. 13 shows an address driving circuit according to a second exemplary embodiment of the present invention.

FIG. 13 shows an address driving circuit according to a second exemplary embodiment of the present invention. For description, the body diodes of the switches AL1, AL2, AH1, and AH2 are illustrated in FIG. 13.

Referring to FIG. 13, in the address driving circuit according to the second exemplary embodiment, the diode Dg shown in FIG. 5 is eliminated. When the current in the positive direction remains in the inductor L after the voltage of the panel capacitor Cp1 or Cp2 reaches about 0V as described in the second and sixth modes M2 and M6 of FIG. 9, the current in the positive direction remaining in the inductor L is recovered to the capacitor C2 through the path of the body diodes of the switches AL1 and AL2, the body diodes of the switches AH1 and AH2, the inductor L, the switch Aerc and the capacitor C2.

In the first and second exemplary embodiments, the resonance current in the positive direction formed by resonance between the panel capacitor Cp and the inductor L flows through the switch Aerc, and the resonance current in the negative direction flows through the body diode of the switch Aerc. Then, the two switches and the two diodes used in the resonance path of the conventional power recovery circuit can be reduced to the one switch. However, more thermal stress can be applied to the switch Aerc since both the resonance current in the positive direction and the resonance current of the negative direction flow through the switch Aerc. The exemplary embodiments that can reduce the thermal stress of the switch Aerc will be described with reference to FIGS. 14 to 16.

Figure 14:
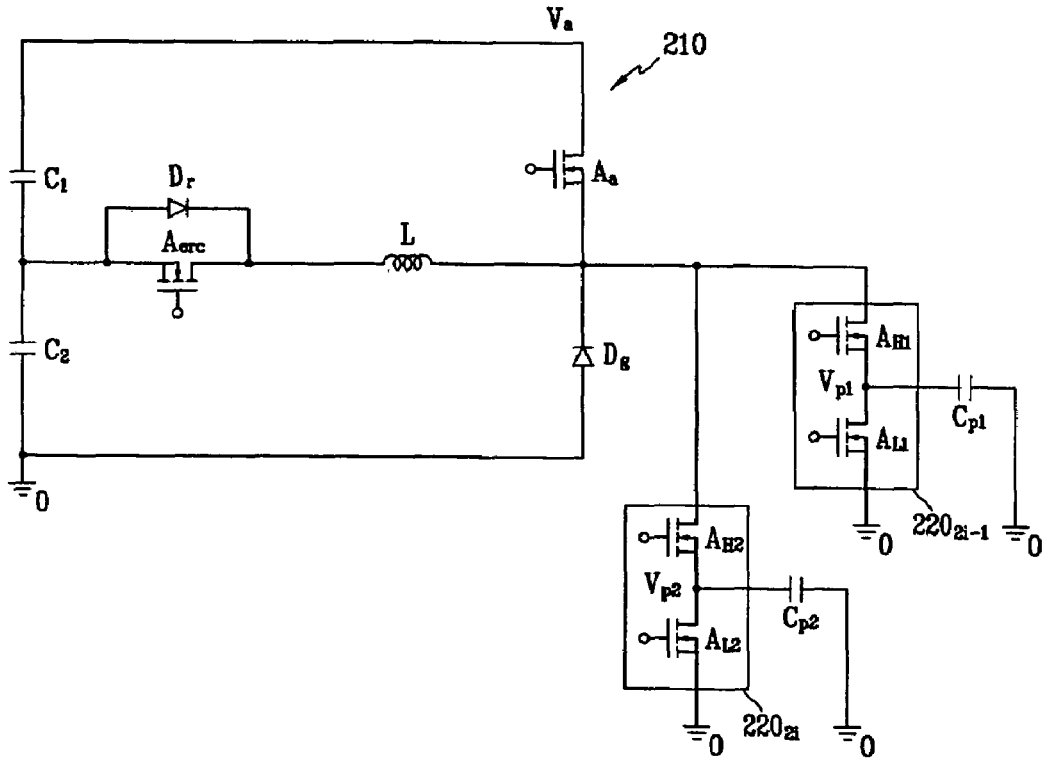
FIG. 14 shows an address driving circuit according to a third exemplary embodiment of the present invention.
Figure 15:
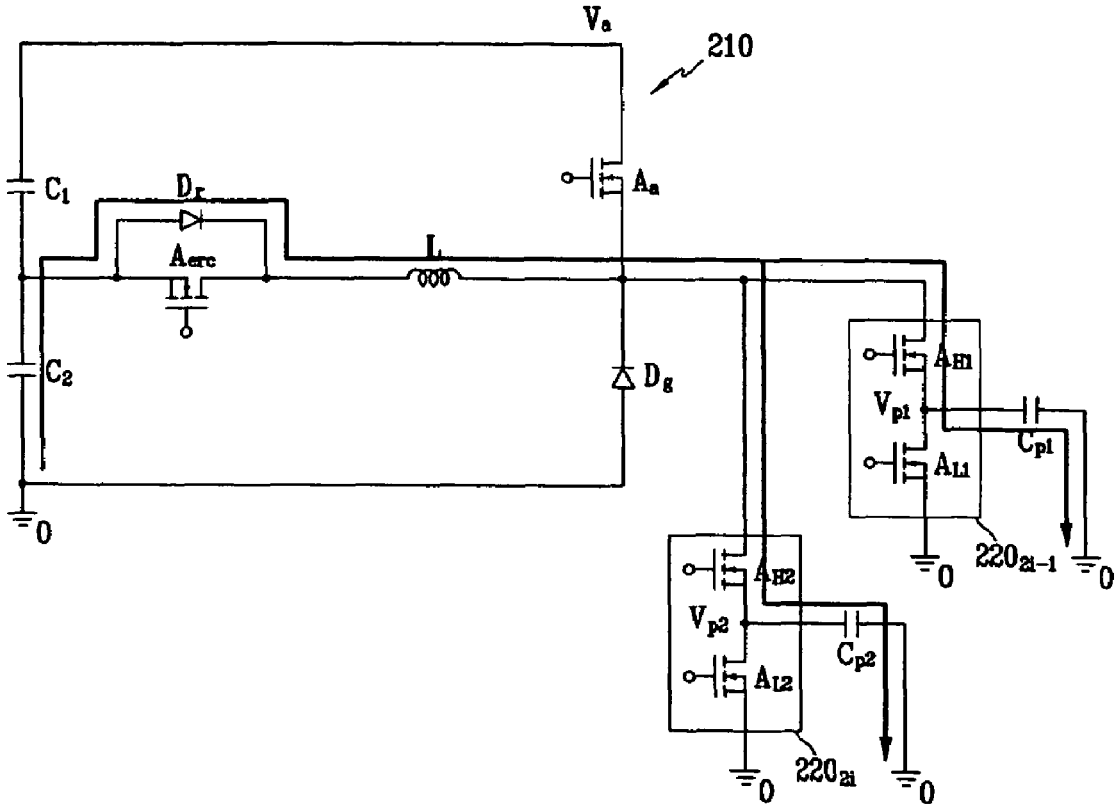
FIG. 15 shows the current of the negative direction in the circuit of FIG. 14.
Figure 16:
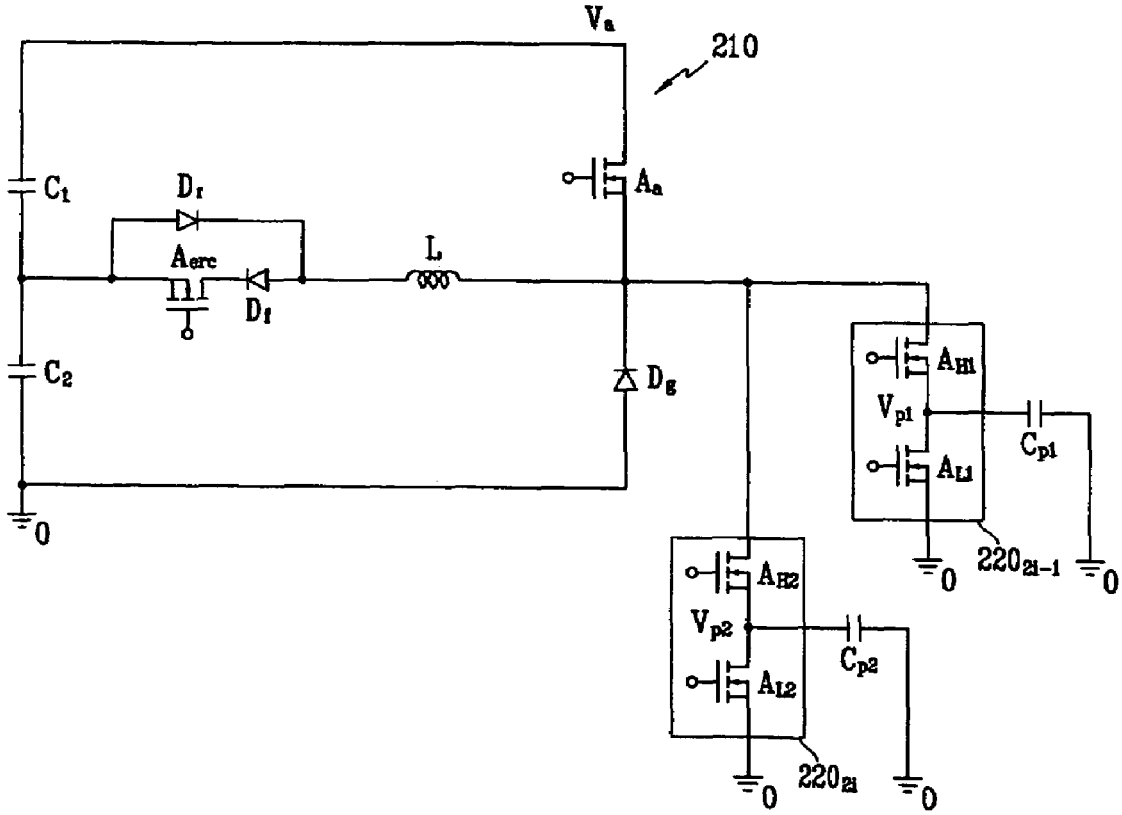
FIG. 16 shows an address driving circuit according to a fourth exemplary embodiment of the present invention.

FIGS. 14 and 16 show an address driving circuits according to third and fourth exemplary embodiments of the present invention, respectively. FIG. 15 shows the current of the negative direction in the address driving circuit of FIG. 14.

Referring to FIG. 14, the address driving circuit according to the third exemplary embodiment of the present invention differs from the first exemplary embodiment further including a diode Dr connected to the switch Aerc in parallel. The cathode of the diode Dr is connected to the drain of the switch Aerc, and the anode of the diode Dr is connected to the source of the switch Aerc. Then, the current in the positive direction flows through the switch Aerc as described in FIGS. 10A, 10B, 10E, 10F, 12A, and 12B. As shown in FIG. 15, the current in the negative direction charging the panel capacitors Cp1 and/or Cp2 is supplied to the panel is capacitors Cp1 and/or Cp2 through the path of the capacitor C2, the diode Dr, and the inductor L, and the current remaining in the inductor L after charging the panel capacitors Cp1 and/or Cp2 is recovered to the voltage source Va through the path of the capacitor C2, the diode Dg, the inductor L, and the body diode of the switch Aa.

Referring to FIG. 16, the address driving circuit according to the fourth exemplary embodiment of the present invention further differs from the third exemplary embodiment by including a diode Df. The cathode of the diode Df is connected to the drain of the switch Aerc, and the anode of the diode Df is connected to the common node of the cathode of the diode Dr and the inductor L. The current in the negative direction can flow through both the diode Df and the body diode of the switch Aerc in the circuit of FIG. 14, but the current in the negative direction flowing through body diode of the switch Aerc can be blocked by the diode Df in the circuit of FIG. 16.

That is, the current of the positive direction formed in the first, second, fifth, and sixth modes M1, M2, M5, and M6 of FIG. 9 and the first and second modes M1 and M2 of FIG. 11 is supplied to the capacitor C2 through the path of the inductor L, the diode Df, and the switch Aerc, and the current of the negative direction formed in the third and seventh modes M3 and M7 of FIG. 9 and the third mode M3 of FIG. 11 is supplied to the panel capacitors Cp1 and/or Cp2 through the path of the capacitor C2, the diode Dr, and the inductor L. As a result, the currents of the positive direction and the negative direction are dispersed so that the thermal stress of the switch Aerc is reduced.

The diode Df is connected between the common node of the diode Dr and the inductor L and the switch Aerc in FIG. 16. In addition, the cathode and the anode of the diode Df can be connected to the anode of the diode Dr and the source of the switch Aerc, respectively. That is, the diode can be formed on the path which can block the current flowing through the body diode of the switch Aerc and cannot block the current flowing through the switch Aerc.

According to the present invention, the power recovery operation is performed in the pattern with many switching variations of the address selecting circuit. Further, the power recovery operation is automatically stopped in the pattern without switching variations of the address selecting circuit, thereby reducing the power consumption. The zero-voltage switching is performed when the address voltage is applied since an external capacitor is charged with a value greater than half of a predetermined voltage. In addition, the switch connected to the ground voltage in the conventional power recovery circuit can be eliminated. Furthermore, one switch can be eliminated since the same switch is used when raising the voltage of the panel capacitor and reducing the voltage of the panel capacitor.

While this invention has been described in connection with exemplary embodiments, it is to be understood that the invention is not limited to the disclosed embodiments, but is intended to cover various modifications and equivalent arrangements included within the spirit and scope of the appended claims.

What is claimed is:

1. A plasma display device comprising:

a panel including a plurality of first electrodes extending in a first direction and a plurality of second electrodes extending in a second direction intersecting the first electrodes;

a first driving circuit sequentially applying a first voltage to the first electrodes;

a plurality of selecting circuits respectively coupled to the second electrodes for selecting second electrodes to which a second voltage will be applied from among the second electrodes; and a second driving circuit coupled to first ends of the selecting circuits for applying the second voltage to the second electrodes selected by the selecting circuits, wherein the second driving circuit includes:

a capacitor;

a first transistor having a first end coupled to the first ends of the selecting circuits and a second end coupled to a first end of the capacitor;

an inductor coupled between the first ends of the selecting circuits and the first end of the first transistor or between the second end of the first transistor and the first end of the capacitor; and a second transistor coupled between the first ends of the selecting circuits and a voltage source supplying the second voltage.

2. The device of claim 1, wherein the second driving circuit reduces the voltage of the second electrode by using a first current of a first direction formed from the second electrode to the capacitor through the inductor, and raises the voltage of the second electrode by using a second current of a second direction formed from the capacitor to the second electrode through the inductor.

3. The device of claim 2, wherein the first transistor has a body diode having the cathode corresponding to the first end of the first transistor and the anode corresponding to the second end of the first transistor, and the first current flows through the first transistor, and the second current flows through the body diode of the first transistor.

4. The device of claim 2, wherein the second driving circuit further includes a first diode having the cathode coupled to the first end of the first transistor and the anode coupled to the second end of the first transistor.

5. The device of claim 4, wherein the first current flows through the first transistor, and the second current flows through the first diode.

6. The device of claim 5, wherein the second driving circuit further includes a second diode coupled between the second end of the first transistor and the anode of the first diode or between the cathode of the first diode and the first end of the first transistor, and the second diode is provided in a direction where a current of the second direction is blocked.

7. The device of claim 2, wherein the second driving circuit applies the second voltage to the second electrode after raising the voltage of the second electrode.

8. The device of claim 7, wherein when a current of the first direction remains in the inductor after the voltage of the second electrode is reduced to a predetermined voltage by the first current, the remaining current of the first direction is recovered to the capacitor, and the second current of the second direction flows from the capacitor to the inductor after the current of the first direction is reduced to about 0 amperes.

9. The device of claim 8, wherein the second driving circuit further includes a diode having an anode coupled to a second end of the capacitor and a cathode coupled to the inductor, and the current of the first direction is recovered to the capacitor through the diode.

10. The device of claim 8, wherein each selecting circuit includes a third transistor coupled between the first end of the selecting circuit and the second electrode, and a fourth transistor coupled between the second electrode and the predetermined voltage, and the current of the first direction is recovered to the capacitor through a body diode of the third transistor and a body diode of the fourth transistor.

11. The device of claim 7, wherein the second driving circuit supplies a third current of the first direction to the inductor and the capacitor through the second transistor and the first transistor while substantially maintaining the voltage of the second electrode at the second voltage, before reducing the voltage of the second electrode.

12. The device of claim 7, wherein when a current of the second direction remains in the inductor after the voltage of the second electrode rises to the second voltage by the second current, the remaining current of the second direction is recovered to the voltage source through the inductor and the body diode of the second transistor.

13. The device of claim 7, wherein each selecting circuit includes a third transistor coupled between the first end of the selecting circuit and the second electrode, and a fourth transistor coupled between the second electrode and the predetermined voltage, the second electrodes being coupled to the selecting circuits of the turned-on third transistors among the selecting circuits are selected, and that the voltage of the second electrode is reduced to the voltage higher than the predetermined voltages when the voltage of the second electrode is reduced to the predetermined voltage when the fourth transistor is turned on.

14. The device of claim 7, wherein the voltage charged to the capacitor by the current of the first direction is higher than the voltage discharged from the capacitor by the current of the second direction.

15. The device of claim 7, wherein the voltage of the capacitor corresponds to a voltage between half of the second voltage and the second voltage.

16. The device of claim 7, wherein the voltage of the capacitor is variable by the current of the first direction and the current of the second direction.

17. A plasma display device comprising:

a panel including a plurality of first electrodes extending in a first direction and a plurality of second electrodes extending in a second direction intersecting the first electrodes;

a first driving circuit sequentially applying a first voltage to the first electrodes;

a plurality of selecting circuits respectively coupled to the second electrodes for selecting second electrodes to which data will be applied from among the second electrodes; and a second driving circuit including a first transistor having a body diode, an inductor and a capacitor for applying the second voltage to the second electrodes selected by the selecting circuits, wherein the second driving circuit applies the second voltage to the selected electrode after charging a capacitive load formed by the selected second electrode and the first electrode by discharging the capacitor through the inductor, and charges the capacitor by discharging the capacitive load through the inductor; and a current charging the capacitive load includes a current flowing through the first transistor, and a current discharging the capacitive load includes a current flowing through the body diode of the first transistor.

18. The device of claim 17, wherein the second driving circuit further includes a first diode coupled in parallel to the first transistor, and the current discharging the capacitor further includes a current flowing through the first diode.

19. The device of claim 17, wherein the second driving circuit supplies a current to the capacitor through the inductor before discharging the capacitive load.

20. The device of claim 17, wherein the capacitive load is discharged to a third voltage by operation of the selecting circuit when a residual voltage higher than a predetermined voltage is charged to the capacitive load after the capacitive load is discharged.

21. The device of claim 20, wherein each selecting circuit includes a second transistor coupled between a common node between the selecting circuit and the second driving circuit and the second electrode, and a third transistor coupled between the second electrode and the third voltage, and the second electrode is selected by the turn-on of the second transistor.

22. The device of claim 21, wherein the residual voltage of the capacitive load is discharged to the third voltage by the turn-on of the third transistor.

23. The device of claim 17, wherein the voltage discharged from the capacitor by the current having the same direction as that of the current flowing in the inductor when the voltage of the second electrode increases is higher than the voltage charged to the capacitor by the current having the same direction as that of the current flowing in the inductor when the voltage of the second electrode is reduced.

24. A plasma display device comprising:

a panel including a plurality of first electrodes extending in a first direction and a plurality of second electrodes extending in a second direction intersecting the first electrodes;

a first driving circuit sequentially applying a first voltage to the first electrodes;

a plurality of selecting circuits respectively coupled to the second electrodes for selecting second electrodes to which data will be applied from among the second electrodes; and a second driving circuit including a first transistor, a first diode coupled in parallel to the first transistor, an inductor and a capacitor for applying the second voltage to the second electrodes selected by the selecting circuits, wherein the second driving circuit applies the second voltage to the selected electrode after charging a capacitive load formed by the selected second electrode and the first electrode by discharging the capacitor through the inductor, and charges the capacitor by discharging the capacitive load through the inductor; and a current charging the capacitive load includes a current flowing through the first transistor, and a current discharging the capacitive load includes a current flowing through the first diode.

25. The device of claim 24, wherein the second driving circuit further includes a second diode for blocking the current flowing through the first diode of the first transistor.

26. The device of claim 24, wherein the capacitive load is discharged to a third voltage by operation of the selecting circuit when a residual voltage higher than a predetermined voltage is charged to the capacitive load after the capacitive load is discharged.

27. A driving device of a plasma display panel on which a plurality of address electrodes and scan electrodes are formed, a capacitive load being formed by the address electrode and the scan electrode, the driving device comprising:

an inductor having a first end coupled to the address electrodes;

a capacitor having a first end coupled to a second end of the inductor and a second end coupled to a first voltage source supplying a first voltage;

a first transistor coupled between the second end of the inductor and the first end of the capacitor or between the address electrodes and the first end of the inductor, the first transistor forming a current path of a first direction when being turned on;

a first diode coupled in parallel to the transistor, forming a current path of a second direction; and a second transistor coupled between the address electrodes and a second voltage source supplying a second voltage, wherein the voltage of the address electrode is reduced by a first current of the first direction formed by turn-on of the first transistor, and the voltage of the address electrode increases by a second current of the second direction formed by the first diode after the current of the first direction is reduced.

28. The driving device of claim 27, wherein the first diode is a body diode of the first transistor.

29. The driving device of claim 28, wherein the cathode and the anode of the first diode are coupled to the first end and the second end of the first transistor, respectively, further comprising a second diode blocking the current of the second direction formed between the first end of the first transistor and the cathode of the first diode or between the second end of the first transistor and the anode of the first diode.

30. The driving device of claim 27, wherein the voltage of the address electrode increases from the third voltage by the second current of the second direction when the voltage of the address electrode is reduced to a third voltage higher than the first voltage by the first current of the first direction.

31. The driving device of claim 30, further comprising a second diode having the anode coupled to the second end of the capacitor and the cathode coupled to the first inductor, wherein the remaining current of the first direction is recovered to the capacitor throught the second diode when a current of the first direction remains in the inductor after the voltage of the address electrode is reduced to the first voltage by the first current of the first direction.

32. The driving device of claim 30, wherein a third current of the first direction is supplied to the inductor and the capacitor before reducing the voltage of the address electrode.

33. The driving device of claim 32, wherein the third current of the first direction is supplied from the second voltage source by turn-on of the first transistor and the second transistor, and the voltage of the address electrode is reduced by turn-off of the second transistor while the first transistor is turned on.

34. The driving device of claim 33, wherein the second voltage is applied to the address electrode by turn-on of the second transistor after the voltage of the address electrode increases.

35. The driving device of claim 27, wherein the second voltage is the ground voltage.

36. A driving method of a plasma display panel on which a plurality of first electrodes and second electrodes are formed, and which includes an inductor coupled to first ends of selecting circuits having output ends coupled to the first electrodes, a capacitive load being formed by the first electrode and the second electrode, the driving method comprising the steps of:

reducing the voltages of the first electrodes selected by the selecting circuits among the first electrodes by discharging a current in a first direction from the selected first electrodes through the inductor;

selecting the first electrodes to which a first voltage will be applied, among the first electrodes selected by the selecting circuits;

raising the voltages of the selected first electrodes by using a current of a second direction which is formed through the inductor after the current of the first direction is about 0 amperes and is opposite to the first direction; and applying the first voltage to the selected first electrodes, wherein the current path of the first direction is formed through a transistor coupled to the inductor, and the current path of the second direction is formed through a diode coupled in parallel to the transistor.

37. The driving method of claim 36, further comprising the step of supplying a current of the first direction to the inductor before reducing the voltages of the selected first electrodes.

38. The driving method of claim 36, wherein a second voltage is applied to the first electrodes not selected by the selecting circuits.

39. The driving method of claim 38, wherein the first end voltage of the selecting circuit is substantially the same as the voltage of the selected first electrode, and the first end voltage of the selecting circuit increases from the third voltage by the current of the second direction when the first end voltage of the selecting circuit is reduced to a third voltage higher than the second voltage when the current of the first direction is about 0 amperes.

40. The driving method of claim 36, wherein the diode is a body diode of the transistor.

41. A plasma display device comprising:

a panel including a plurality of first electrodes extending in a first direction and a plurality of second electrodes extending in a second direction intersecting the first electrodes;

a means for sequentially applying a first voltage to the first electrodes;

a plurality of means for selecting respectively coupled to the second electrodes and for selecting second electrodes to which data will be applied from among the second electrodes; and a means for applying the second voltage to the second electrodes selected by the selecting circuits, wherein the means for applying the second voltage applies the second voltage to the selected electrode after charging a capacitive load formed by the selected second electrode and the first electrode by discharging a capacitor through an inductor, and charges the capacitor by discharging the capacitive load through the inductor; and a current charging the capacitive load includes a current flowing in a first direction through the means for applying the second voltage, and a current discharging the capacitive load includes a current flowing in a second direction through the means for applying the second voltage.

42. A plasma display device comprising:

a panel including a plurality of first electrodes extending in a first direction and a plurality of second electrodes extending in a second direction intersecting the first electrodes;

a means for sequentially applying a first voltage to the first electrodes;

a plurality of means for selecting respectively coupled to the second electrodes and for selecting second electrodes to which data will be applied from among the second electrodes; and a means for applying the second voltage to the second electrodes selected by the mechanisms that act to select, wherein the means for applying the second voltage applies the second voltage to the selected electrode after charging a capacitive load formed by the selected second electrode and the first electrode by discharging a capacitor through an inductor, and charges the capacitor by discharging the capacitive load through the inductor; and a current charging the capacitive load includes a current flowing in a first direction through the means for applying the second voltage, and a current discharging the capacitive load includes a current flowing in a second direction through the means for applying the second voltage.

* * * * *